US012345109B2

(12) United States Patent
Ogundare et al.

(10) Patent No.: US 12,345,109 B2
(45) Date of Patent: Jul. 1, 2025

(54) SYSTEMS AND METHODS FOR OPTIMIZATION OF WELLBORE OPERATIONS OF PRODUCING WELLS

(71) Applicant: Halliburton Energy Services, Inc., Houston, TX (US)

(72) Inventors: Oluwatosin Ogundare, The Woodlands, TX (US); Jeremy C. Nicholson, Houston, TX (US); Eric Lynn Jantz, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 71 days.

(21) Appl. No.: 18/489,948

(22) Filed: Oct. 19, 2023

(65) Prior Publication Data

US 2025/0129679 A1 Apr. 24, 2025

(51) Int. Cl.
*E21B 19/22* (2006.01)
*E21B 21/08* (2006.01)

(52) U.S. Cl.
CPC ..... *E21B 21/08* (2013.01); *E21B 19/22* (2013.01); *E21B 2200/20* (2020.05)

(58) Field of Classification Search
CPC ..... E21B 19/22; E21B 21/08; E21B 2200/20
See application file for complete search history.

(56) References Cited

U.S. PATENT DOCUMENTS 5,660,239 A * 8/1997 Mueller ..... E21B 44/00 175/57
10,174,600 B2 * 1/2019 Livescu ..... E21B 31/005
11,808,097 B2 * 11/2023 Morrison ..... E21B 47/12
2008/0115941 A1 * 5/2008 Elder ..... E21B 31/113 166/301
2012/0018148 A1 1/2012 Bryant
2012/0247778 A1 * 10/2012 Noles, Jr. ..... C09K 8/588 166/310
2014/0126330 A1 5/2014 Shampine
2023/0070218 A1 * 3/2023 Al-Baiyat ..... E21B 47/09
(Continued)

FOREIGN PATENT DOCUMENTS

WO 2019245575 A1 12/2019
WO 2021015740 A1 1/2021

OTHER PUBLICATIONS

International Search Report and Written Opinion dated Jul. 15, 2024 for related PCT Application No. PCT/US2023/077496 filed Oct. 23, 2023.

(Continued)

*Primary Examiner* — Matthew R Buck
(74) *Attorney, Agent, or Firm* — K&L Gates LLP

(57) ABSTRACT

Systems and methods for performing an intervention operation in a wellbore using a friction reducer fluid include a coiled tubing insertable into the wellbore, a pump operable to pump the friction reducer fluid through the coiled tubing and into the wellbore, and sensors operable to detect wellbore conditions. A controller including a processor is operable to automatically predict a wellbore depth at which the coiled tubing will incur a lock-up in the future based on the wellbore conditions and control the pump to pump the friction reducer fluid though the coiled tubing and into the wellbore to prevent the future lock-up.

20 Claims, 8 Drawing Sheets

(56) References Cited

U.S. PATENT DOCUMENTS

2025/0027402 A1* 1/2025 Abuhaikal ..... E21B 47/04

OTHER PUBLICATIONS

Lianzhong, Sun et al., "A numerical method for determining the stuck point in extended reach drilling", 2011, 8 pages, Petroleum Science.

Menand, Stéphane, A. Bjorset, and Ludovic Macresy. "A new buckling model successfully validated with full-scale buckling tests." 8 pages, AADE 2011 National Technical Conference & Exhibition. 2011.

* cited by examiner

SYSTEMS AND METHODS FOR OPTIMIZATION OF WELLBORE OPERATIONS OF PRODUCING WELLS

BACKGROUND

After drilling a wellbore in a subterranean formation for recovering desirable hydrocarbons such as oil and gas lying beneath the surface and then subsequent production of the desirable hydrocarbons from the well, a well intervention operation may be performed to manage production from the well. For example, a well intervention may be performed to address such issues as moving parts and seals wearing out, tubulars developing leaks, sensors failing, and formation pressures declining. An intervention may also be performed to change or adjust downhole equipment such as valves or pumps and to gather downhole pressure, temperature, and flow data.

During the well intervention, coiled tubing ("CT") is transported into the wellbore and may be used to carry tools and/or sensors downhole. Although potentially used for carrying tools and sensors, CT may also be used as a conduit for fluid. For example, CT is used to wash out production-inhibiting sand or scale that has built up inside production tubing or to place chemical or other treatments at precise locations within the well.

Wellbores may also be drilled at high angles or horizontally to increase the surface of the wellbore in a reservoir containing desirable hydrocarbons. Because CT has some rigidity, CT may be more effective at pushing tools, which typically depend on gravity or tractors to move downhole in high-angle wells. Precise CT transportation may be difficult in horizontal wellbores though due to forces of friction of the coiled tubing contacting the wellbore wall or completion components due to gravity. To achieve CT transportation in horizontal wellbores a CT injection operation must overcome forces of friction. Otherwise, the coiled tubing has the potential to snake and to lockup due to wellbore characteristics such as geometry, completion components, wellbore/pipe interior surface roughness, wellbore trajectory, etc.

To overcome friction forces, the diameter of the CT or rotating the CT may theoretically be possible. However, larger-diameter CT creates logistical challenges with road transport and crane-lifting/loading limitations. Also, CT rotation, similar to drill pipe rotation, may not be economically practical with current CT technologies.

Instead, to transfer forces to CT extended into the well, technologies such as friction reducer fluids are traditionally used to extend the CT reach. However, how to determine the optimal start time and pump rate for pumping a friction reducer fluid ("FR"), such that lock-up can be avoided, with the minimal amount of FR required can be difficult. Determinations may be made by modeling downhole conditions and forces, however model parameters may vary during pump down operation. For example, the drag coefficient and friction coefficient between the CT and horizontal wellbore may vary in terms of time. All these factors contribute to a process with varying parameters resulting in complex modeling. Thus, achieving desired CT transportation in horizontal wellbores is a challenge.

Also, after drilling a wellbore in a subterranean formation for recovering desirable hydrocarbons such as oil and gas lying beneath the surface and then subsequent production of the desirable hydrocarbons from the well, a number of situations arise in which solids or debris are present in production fluids, such as sand or scale. Accumulation of such solids or debris over time can decrease the flowrate of production fluids from the well, lowering the production value of the well.

To help remove the solids or debris, a conveyance, e.g., coiled tubing ("CT"), may be transported into the wellbore and may be used to carry tools, nozzles, and/or sensors downhole. Although potentially used for carrying tools and sensors, CT may also be used as a conduit for fluid. For example, CT is used to wash out production-inhibiting sand or scale that has built up inside production tubing or to place chemical or other treatments at precise locations within the well. To do so, a circulating fluid is pumped down the CT and then up the annulus of the CT inside the production tubing. The circulating fluid may include an aqueous fluid, a surfactant, an acid, or other chemical to break up or dislodge the debris or solids and flow the removed debris or solids out of the production tubing.

The effectiveness of a wellbore cleanout treatment can be affected by multiple factors, including fluid velocity, pipe eccentricity, deviation angle, fluid characteristics, and particle qualities. The effectiveness of a cleanout out treatment must also be weighed against the cost not only in time but also in materials and labor in performing the cleanout operation. Thus, there exists a need to be able to make a decision on whether to perform a wellbore cleanout operation based on effectiveness and, if so, how to make the operation the most efficient in terms of time and cost.

In addition, many oil and gas wells will experience liquid loading at some point in their productive lives due to a reservoir's inability to provide sufficient energy to carry wellbore liquids, such as reservoir fluids, to the surface. The liquids that accumulate in the wellbore may cause the well to cease flowing or flow at a reduced rate. To increase or re-establish the production, operators may perform artificial lift operations, which are methods of removing wellbore liquids to the surface by applying a form of energy into the wellbore. Example artificial lift operations include downhole pumping systems, plunger lift systems, and compressed gas lift systems.

In gas lift systems, compressed gas flows into the annulus outside the production tubing and inside the casing of the well and travels down the wellbore and into the production tubing through a series of gas lift valves. If the gas pressure in the casing-tubing annulus is sufficiently high compared to the pressure inside the production tubing adjacent to one of the valves, the gas lift valve will open and allow gas in the annulus to enter the production tubing. Allowing the gas into the production tubing allows the gas to mix with reservoir fluids and decrease the overall density of the production fluid in the production tubing. Mixing also decreases the hydrostatic pressure of the fluid column in the production tubing, thus effectively lifting the production fluid in the tubing out of the wellbore. Usually, gas is injected into the annulus until a pressure set-point is reached, regardless of the actual performance of the gas lift operation.

In performing a gas lift operation, static wellbore pressure and productivity index related to the gas lift are challenging to measure. Too few engineers monitor, evaluate, update, and assess gas injection rates to determine well lift performance. A qualified engineer may need a half-day to build and analyze a simulation model to establish a gas injection rate due to the work necessary to gather sensor data, completion and lift design data, and reservoir and fluid characteristics.

Additionally, throughout a well's life, the gas lift pressure set-point must be adjusted because aging or treatments like workover may induce a deviation from previously effective set-points. Considering this criterion, a human-driven analysis to determine a new set-point may take many days per engineer per well and possibly result in engineering years for many well fields. Due to large number of wells, production engineers and well managers are unlikely to routinely conduct this challenging procedure. This produces infrequent optimization, which reduces production, injection gas, or both. Hence, automation is needed as a scalable solution to this problem.

BRIEF DESCRIPTION OF THE DRAWINGS

Aspects of the disclosure are described with reference to the following figures, the features of which are not necessarily shown to scale. Some details of elements may not be shown in the interest of clarity and conciseness.

DETAILED DESCRIPTION

Figure 1:
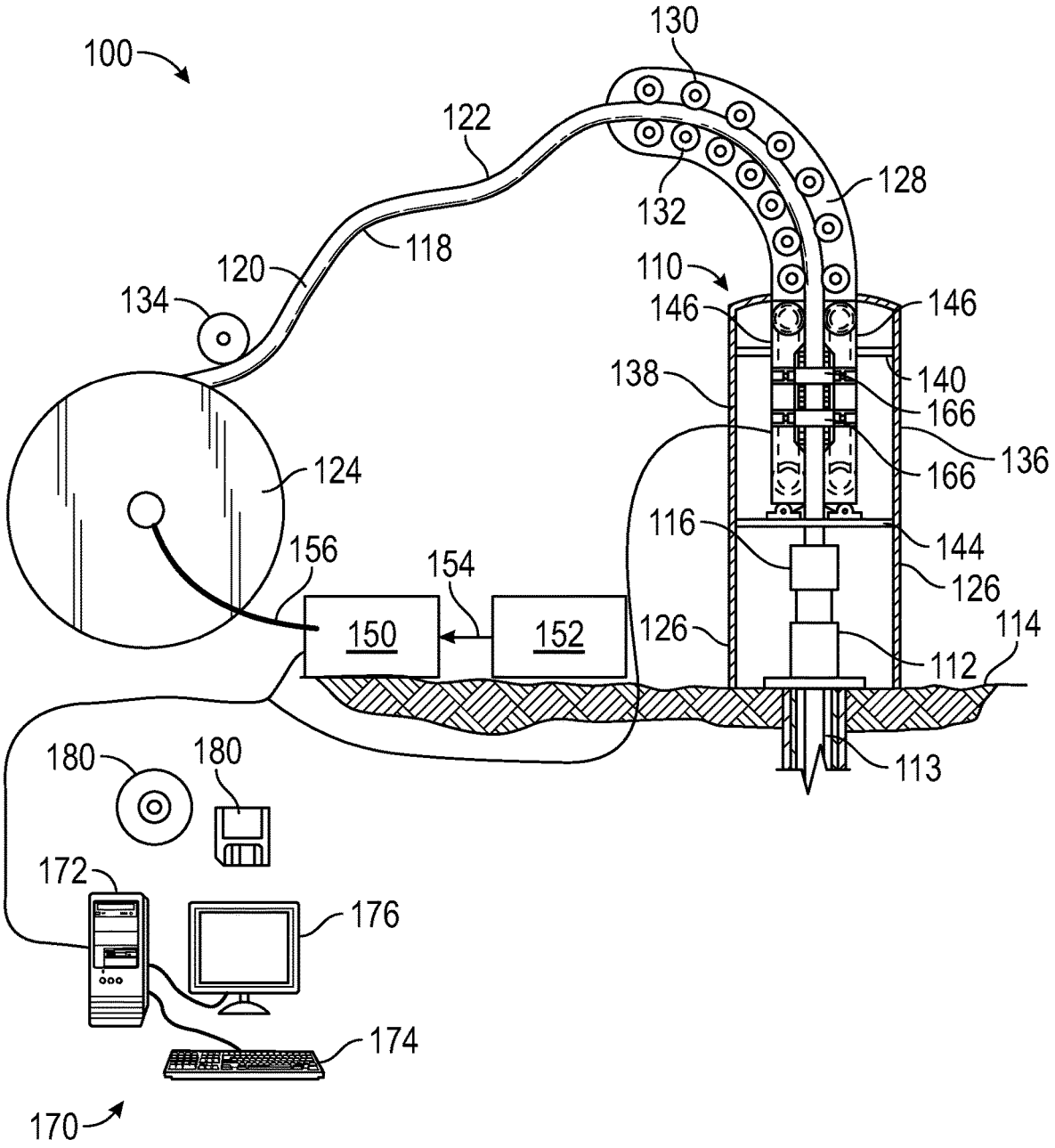
FIG. 1 is a schematic of an example coiled tubing injector system with which aspects of the present disclosure may be practiced.

The present disclosure describes improved systems and methods for injecting coiled tubing ("CT") into a wellbore while automatically predicting any future lock-up of the coiled tubing in the wellbore and automatically pumping a friction reducer fluid ("FR") into the wellbore to prevent the predicted future lock-up.

The disclosed system and methods provide several practical applications and technical advantages that improve the operation of a CT system. For example, the disclosed systems provide the practical application of automatically predicting a wellbore depth at which CT being injected into a wellbore may incur a lock-up in the future. As used herein, a "lock-up" occurs when at any portion along the unspooled length of the CT or any portion of a toolstring attached to the CT, a drag force on the CT or the toolstring is equal to or greater than a critical buckling load of the CT or the toolstring.

As described in accordance with one or more embodiments of the present disclosure, a controller that includes a processor monitors wellbore conditions detected using sensors. Using the wellbore conditions, the controller automatically predicts one or more wellbore depths at which the CT will incur a lock-up in the future. The depth prediction does not necessarily pinpoint an exact depth the lock-up will absolutely occur. Instead, the prediction is based on a depth near which the lock-up is likely to occur. To predict the wellbore depth of the future lock-up, the wellbore conditions are input into a model of the CT that includes forward equation modeling the state of the unspooled portion of the CT and any attached toolstring based on observed measurements. An inversion process is then performed on the results of the model forward equation to determine a current friction coefficient for any position along the unspooled portion of the CT and attached toolstring. The current friction coefficient may then be input into a generative model to predict a future value of the friction coefficient for the position at a future wellbore depth. As used herein, a generative model is a statistical model of probability distribution. For example, the generative model may be a Markov decision process, which is a time-finite state recurrent Markov chain representing mean friction factors, predicting the next value of the friction coefficient. The predicted future friction coefficient may then be used in a torque-drag model of the unspooled portion of the CT or attached toolstring to determine, or predict, a future drag force at the position for future wellbore depths. The controller then automatically predicts any wellbore depth at which the CT will incur a lock-up if the predicted drag force at a position is equal to or greater than a critical buckling load at the position. Once a wellbore depth at which a predicted future lock-up will occur is known, the controller automatically controls a pump to pump a FR through the CT and into the wellbore to ensure that the friction reducer reaches the position at the predicted wellbore depth to prevent the future lock-up.

The forward equation and generative model provide the controller the ability to automatically predict and prevent future lock-ups. For example, the generative model and the torque-drag model provide the ability of the controller to automatically control the pumping of friction reducer into the wellbore before the lock-up occurs to prevent a lock-up and continue the injection of the CT. In addition, the process of anticipating future lock-ups involves determining future friction coefficients and drag forces. Using this information, the controller is also able to automatically determine the optimal amount of FR to be pumped into the wellbore to prevent the lock-up. In most cases, the optimal amount of FR will be the minimum amount of FR required to prevent the lock-up. Thus, not only is a future lock-up prevented, but the system is optimized by minimizing the amount of FR pumped into the wellbore to do so. In one or more embodiments, the controller is operable to continuously monitor wellbore conditions as the CT injection operation is performed and adjust the amount of FR, the pump start time, and/or pump rate of the FR as needed. For example, the controller may be operable to automatically determine and adjust the optimal amount of FR continuously, periodically, randomly, or based on a pre-selected schedule. The entire operation including monitoring the wellbore conditions related to the operation of injecting the CT and toolstring, predicting the wellbore depth at which a future lock-up will occur, and pumping FR into the wellbore to prevent the lock-up is designed to be fully automatic and not needing operator intervention. Thus, the disclosed systems and methods significantly reduce operator burden. Further, by determining the optimized, or minimum, amount of FR to be pumped into the wellbore in accordance with techniques disclosed herein, the disclosed systems and methods avoid the issue of pumping too little FR, resulting in incurring the lock-up, or too high, resulting in pumping more FR than is needed. Further, automatic operation throughout the operation of injecting the CT may ensure continued injection of the CT and toolstring until a target wellbore depth is reached.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as one or more central processing unit (CPUs) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a display. The information handling system may also include one or more buses operable to transmit communications between the various hardware components. It may also include one or more interface units capable of transmitting one or more signals to a controller, actuator, or like device. Various components of the systems can be integrated such that processing identical to or similar to the processing schemes discussed with respect to various embodiments herein can be performed.

For the purposes of this disclosure, computer-readable media may include any instrumentality or aggregation of instrumentalities that may retain data and/or instructions for a period of time. Computer-readable media may include, for example, without limitation, storage media such as a direct access storage device (for example, a hard disk drive or floppy disk drive), a sequential access storage device (for example, a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing. The instructions stored on the computer-readable media, when performed by a machine, cause the machine to perform operations, the operations comprising one or more features similar or identical to features of methods and techniques described herein.

Illustrative aspects of the present disclosure are described in detail herein. In the interest of clarity, not all features of an actual implementation may be described in this specification. The illustrative examples are given to introduce the reader to the general subject matter of the disclosure and are not intended to limit the scope of the disclosed concepts. The disclosure describes various additional features and examples with reference to the drawings in which like numerals indicate like elements, and directional descriptions are used to describe the illustrative aspects but, like the illustrative aspects, should not be used to limit the present disclosure.

To facilitate a better understanding of the present disclosure, the following examples of certain aspects are given. In no way should the following examples be read to limit, or define, the scope of the invention. Aspects of the present disclosure may be applicable to horizontal, vertical, deviated, or otherwise nonlinear wellbores in any type of subterranean formation. Aspects may be applicable to injection wells as well as production wells, including hydrocarbon wells. Aspects may be implemented using a tool that is made suitable for testing, retrieval, and sampling along sections of the formation. Aspects may be implemented with tools that, for example, may be conveyed through a flow passage in tubular string or using CT.

As another example, the present disclosure also describes improved systems and methods for automatically controlling a wellbore cleanout operation to optimize efficiency based on time and cost. The disclosed system and methods provide several practical applications and technical advantages that improve the operation of a wellbore cleanout system. For example, the disclosed systems provide the practical application of automatically determining locations within a wellbore where a flowrate differential between a recorded flowrate and a modeled flowrate meets or exceeds a predetermined threshold, thus identifying locations that should be considered for cleanout treatment, rather than the entire length of production tubing. Further, if the flowrate differential is not sufficient at any location, an entire wellbore cleanout operation may be avoided altogether, thus saving time and cost.

At the determined locations, the improved systems and methods also provide the practical application of automatically determining if a change in a wellbore cleanout utility function using the modeled flowrate compared to the recorded flowrate is equal to or greater than an improvement factor. If the change is equal to or greater than the improvement factor, the systems and methods automatically control a cleanout tool at the locations to perform the cleanout operation. In this manner, the wellbore cleanout operation is performed only at the locations where the wellbore cleanout operation will meet or surpass an improvement factor, thus minimizing the time and cost of the overall operation and optimizing efficiency compared to performing the wellbore cleanout operation along the entire length of the production tubing.

As described in accordance with one or more embodiments of the present disclosure, a controller that includes a processor monitors wellbore production volume of a production fluid per unit time detected using a sensor or sensors. The controller also automatically estimates an estimated flowrate along a streamline through the wellbore from a reservoir producing the production fluids. From the estimated flowrate, the controller automatically estimates an initial wellbore production volume per unit time. The controller then automatically performs an inversion process using the estimated initial wellbore production volume per unit time and the wellbore production volume of production fluid per unit time detected from the sensor to determine the modeled flowrate for the production fluid at the locations along a production tubing in the wellbore. The modeled flowrate is unique to a particular wellbore environment and different locations along the production tubing may have different modeled flowrates based on the detected wellbore production volume of production fluid per unit time. The controller is then operable to automatically determine if there are any locations or regions which should be considered for a cleanout operation using the predetermined threshold for flowrate differential described above. The controller is then operable to automatically determine locations where a cleanout operation would be beneficial using the improvement factor as described above. If the controller determines there are locations that meet both the predetermined threshold and the improvement factor criteria, then the controller is operable to automatically control a cleanout system to perform the cleanout operation at any of the determined locations. Doing so includes controlling the deployment of a conveyance, such as coiled tubing, and a cleanout tool, such as a nozzle, along the production tubing and controlling a pump to pump fluids, such as chemicals, into the production tubing to clean the production tubing of debris or solids, this improving the flowrate in the production tubing at the determined locations as well as overall for the well. The entire operation including monitoring the wellbore production volume, determining the locations appropriate for a cleanout operation, and controlling the cleanout operation is designed to be fully automatic and not needing operator intervention. Thus, the disclosed systems and methods significantly reduce operator burden. Further, by determining the optimized, or minimum, amount of locations where a cleanout operation would be beneficial in accordance with techniques disclosed herein, the disclosed systems and methods avoid the issue of wasting time and cost in performing cleanout operations that do not sufficiently improve flowrate through the production tubing.

As another example, the present disclosure also describes improved systems and methods for automatically controlling a gas lift operation to optimize efficiency based on performance. The disclosed system and methods provide several practical applications and technical advantages. For example, the disclosed systems and methods provide the practical application of automatically converting a detected bubbles per unit volume measured in a production fluid flowing through a production tubing into a gas/liquid saturation index (GLSI) using a transformation function. The disclosed systems and methods also provide the practical application of automatically executing, at designated intervals, a decision function based on the GLSI to either pump or not pump gas into the wellbore. Further, the disclosed systems and methods also provide the practical application of automatically controlling a pump and a valve to pump gas into an annulus in the wellbore outside the production tubing only when indicated by the decision function.

As described in accordance with one or more embodiments of the present disclosure, a controller that includes a processor that monitors the bubbles in the production fluids during the gas lift operation. The controller also automatically controls the pumping of the gas into the wellbore based on the state of the production fluid with respect to the bubble count. Doing so includes controlling a pump and a valve to pump gas into the wellbore only when additional gas is required in the production fluid to meet performance metrics. Thus, the efficiency of the system and the gas lift operation is improved and optimized by not pumping more gas than is needed to achieve performance metrics for the gas lift operation. The entire operation including monitoring the production fluids, determining whether to operate the pump, and controlling the pump and the valve to control the gas lift operation is designed to be fully automatic and not needing operator intervention. Thus, the disclosed systems and methods significantly reduce operator burden. Further, by determining the optimized, or minimum, amount and timing of gas needed in accordance with techniques disclosed herein, the disclosed systems and methods avoid the issue of inefficiently pumping gas until a designated set-point is reached, regardless of whether the set-point achieves the performance metrics for improving production through the production tubing.

Turning now the figures, FIG. 1 is a schematic diagram of an example CT injector system 100 in which aspects of the present disclosure may be practiced. As shown in FIG. 1, CT injector 110 (also referred to as injector head) is shown positioned above a wellhead 112 of a wellbore 113 at a ground surface or subsea floor 114. A lubricator or stuffing box 116 is connected to the upper end of wellhead 112.

CT 118, having a longitudinal central axis 120 and an outer diameter or outer surface 122, is supplied on a large drum, or reel, 124 and is typically several thousand feet in length. Coiled tubing of sufficient length may be inserted into the wellbore 113 either as single tubing, or as tubing spliced by connectors or by welding. Although not shown in FIG. 1, it will be understood that the CT 118 may also be inserted into a production tubing installed within the wellbore 113. The outer diameters of the CT 118 typically range from approximately one inch (2.5 cm) to approximately five inches (12.5 cm). The CT injector 110 is readily adaptable to even larger diameters. The CT 118 is normally spooled from the drum 124 typically supported on a truck (not shown) for mobile operations.

The CT injector 110 may be mounted above the wellhead 112 on legs 126. A guide framework 128 having a plurality of pairs of guide rollers 130 and 132 rotatably mounted thereon extends upwardly from the CT injector 110. The injector 110 includes a frame 136 with legs 138, rear supports 140, and side supports (not shown). The CT injector 110 further comprises a base 144 that makes up a part of frame 136, and a pair of substantially similar carriages 146 extending upward therefrom. The CT injector 110 also includes hydraulic gripper cylinders 166 for moving the carriages 146 laterally with respect to one another and with respect to the base 144.

CT 118 is supplied from the drum 124 and is run between rollers 130 and 132. As the CT 118 is unspooled from the drum 124, the CT 118 passes adjacent to a length measurement device 134, such as a wheel. Alternatively, the length measurement device 134 may be incorporated in the CT injector 110 itself. The length measurement device 134 measures the length of CT 118 that is unspooled from the drum 124 for use in calculations predicting potential lock-ups downhole. In another example, the measuring device may include a load cell and an encoder. In examples, a load cell may provide the amount of pull on CT 118 at the surface of the wellbore 113 in real-time. As disclosed herein, real-time data is defined as measurements taken during operations during any type or form of measurement operations. Such measurements may be combined as to be discussed later. In examples, as the CT 118 passes through the length measurement device 134 an encoder may be implemented to provide real-time measurements. Real-time measurements may include speed of the CT 118 being injected and the length of the CT 118 that has been unspooled from the drum 124.

The rollers 130 and 132 define a pathway for CT 118 so that the curvature in the CT 118 is straightened as the CT 118 enters the CT injector 110. As will be understood, the CT 118 is preferably formed of a material that is sufficiently flexible and ductile that it can be curved for storage on the drum 124 and also later straightened. While the material is flexible and ductile, and will accept bending around a radius of curvature, the material runs the risk of being pinched or suffering from premature fatigue failure should the curvature be severe. The rollers 130 and 132 are spaced such that straightening of the CT 118 is accomplished wherein the CT 118 is inserted into the wellbore 113 without kinks or undue bending on the CT 118.

The CT injector 110 utilizes a pair of opposed endless drive chains referred to as gripper chains because each chain has a multitude of gripper blocks attached therealong. The gripper chains are driven by respective drive sprockets which are in turn powered by a reversible hydraulic motor. The opposed gripper chains, preferably via the gripper blocks, sequentially grasp the CT 118 that is positioned between the opposed gripper chains. In operation, when it is desired that CT 118 be lowered, raised, or suspended in the wellbore 113, the gripper cylinders 166 may be actuated until the gripper blocks engage the CT 118. When the gripper chains are in motion, each gripper chain has a gripper block that is coming into contact with the tubing as another gripper block on the same gripper chain is breaking contact with the tubing. This continues in an endless fashion as the gripper chains are driven to force the CT 118 into or out of the wellbore, depending on the direction in which the drive sprockets are rotated.

Although not shown, a toolstring may optionally be attached to the end of the CT 118 for conveyance into the wellbore 113. The toolstring may include one or more tools suitable for performing a CT well intervention operation, such as downhole fishing tools, wellbore cleanup tools, reamers, drill bits, injector heads, circulating subs, isolation tools, orientation tools, and centralizers.

Also shown in FIG. 1 are a pump 150 and a container 152 for containing FR and to be pumped by the pump 150 from the container 152 through a fluid line 154. In the direction shown by the arrow. The pump 150 is connected on the downstream end to the CT 118 through a fluid line 156 as will be discussed further below. The pump 150 may be controlled to pump FR from the container 152 into the CT 118 and down into the wellbore 113. The pump 150 may be any suitable pump for pumping FR into the CT 118, for example, the pump 150 may be a centrifugal pump or other pumping equipment.

Although not all shown in FIG. 1, the CT injector system 100 includes sensors, such as the length measurement device 134, that measure operational parameters and wellbore conditions of the CT 118 and any attached toolstring as the CT 118 is being conveyed into the wellbore 113. The sensors may be included as part of the toolstring or may be part of or connected to the CT 118. The CT injector system 100 may also include sensors measuring the operation of the pump 150, the level of the FR in the container 152, the flowrate of FR fluid being pumped into the CT 118, the rate the CT injector 110 is injecting the CT 118, or any other suitable operational parameters.

Systems and methods of the present disclosure may be implemented, at least in part, with an information handling system (IHS) 170. The IHS 170 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, the IHS 170 may include a processor or processing unit 172, a network storage device, or any other suitable device and may vary in size, shape, performance, functionality, and price. The IHS 170 may include random access memory (RAM), one or more processing resources such as a central processing unit (CPU) or hardware or software control logic, read only memory (ROM), and/or other types of nonvolatile memory. Additional components of the IHS 170 may include one or more disk drives, one or more network ports for communication with external devices as well as various input and output (I/O) devices, such as an input device 174 (e.g., keyboard, mouse, etc.) and a video display 176. The IHS 170 may also include one or more buses operable to transmit communications between the various hardware components.

Alternatively, systems and methods of the present disclosure may be implemented, at least in part, with non-transitory computer-readable media 180. Non-transitory computer-readable media 180 may include any instrumentality or aggregation of instrumentalities that may retain data and/or instructions for a period of time. Non-transitory computer-readable media 180 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The IHS 170 at least partially controls the CT injector system 100 for injecting the CT 118 as part of an intervention operation. To control the injector system 100, the IHS 170 may be connected to the pump 150, the drive mechanism for the pump 150, and the CT injector system 100 through a wired connection as shown or through wireless communication. During the injection of the CT 118, the length measurement device 134 may provide information regarding the state of the injection of the CT 118. Sensors may be included that also detect operation parameters of the pump 150, such as flow rate Q, that are communicated to the IHS 170. Additionally, the CT 118 and any attached toolstring may include downhole sensors or additional sensors may be included at or near the wellhead 112 to provide information regarding wellbore conditions. Signals from the sensors may be sent to the IHS 170 in real-time via any mechanism or telemetry system.

Figure 2:
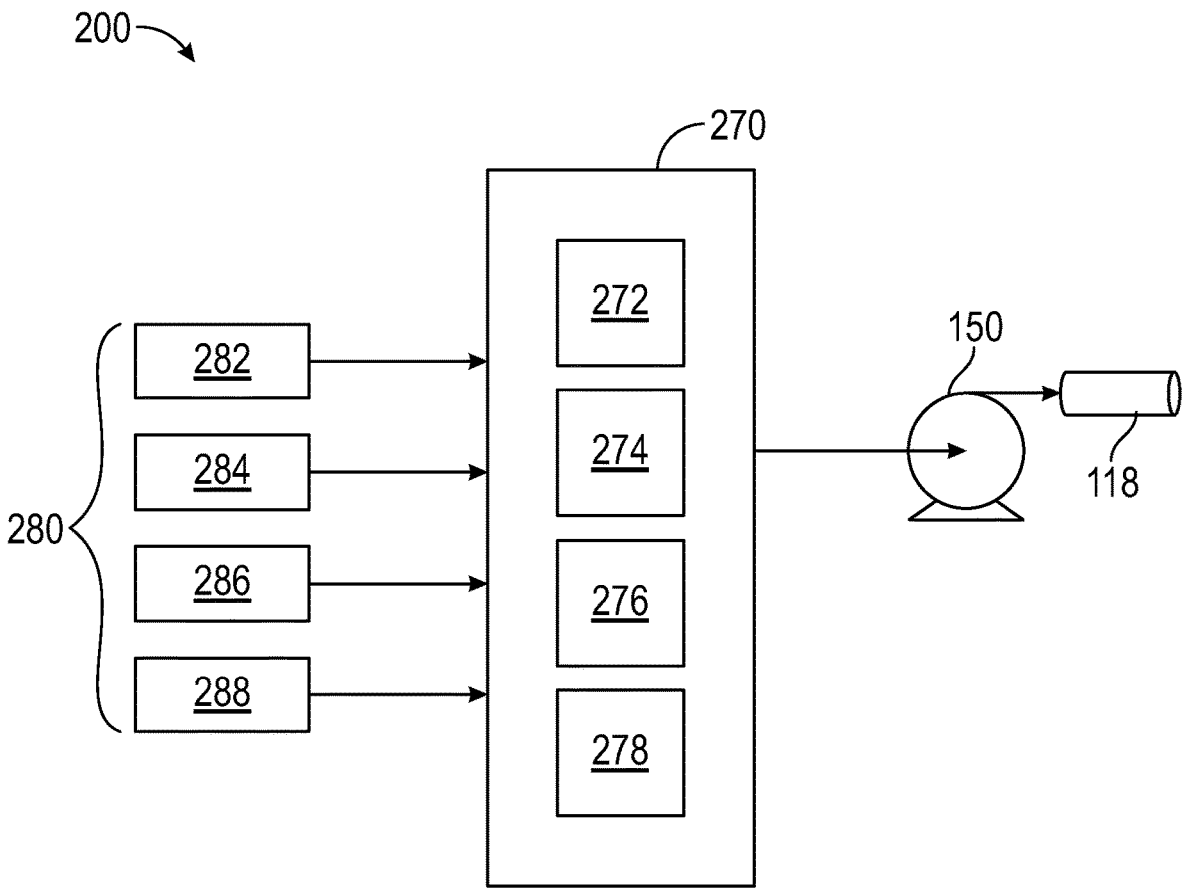
FIG. 2 illustrates a schematic diagram of an example system for performing a wellbore intervention operation using the system of FIG. 1, in accordance with one or more embodiments of the present disclosure.

FIG. 2 illustrates a schematic diagram of an example system 200 for controlling the operation of the pump 150 of the CT injector system 100, in accordance with one or more embodiments of the present disclosure. As shown in FIG. 2, the system 200 includes an information handling system (IHS) 270 similar to the IHS 170 described in FIG. 1 that includes a controller 272. The IHS 270 may be configured to collect data relating to properties of the CT 118, the pump 150, the container 152, and the CT injector 110 as well as measured parameters during the intervention operation. For example, as shown in FIG. 2, the system 200 may include a plurality of sensors 280 detecting various parameters related to the CT injector 110 operation and sending signals feeding the detected data to the IHS 270. As shown, sensors 280 may detect wellbore conditions 282, pump operation parameters 284, unspooled CT length 286, and CT injector operation parameters 288. The wellbore conditions 282 include such conditions as speed of injection of the CT 118, characteristics of the formation through which the wellbore is drilled, a volume of fluid coming out of the wellbore 113 or out of a production tubing within the wellbore 113 per unit time, and compressive loads of the CT 118. The pump operation parameters 284 include such parameters as pump operation status and pump rate. The unspooled CT length 286 may include the total unspooled length of CT plus the length of any toolstring attached to the CT 118. The CT injector operation parameters 288 include such parameters as injection rate, which can be used in determining the velocity of a portion of the CT 118 in the wellbore for predicting a future wellbore depth at which a lock-up may occur.

The signals relating to values of wellbore conditions 282, pump operation parameters 284, unspooled CT length 286, and CT injector operation parameters 288 are fed into the IHS 270 and ultimately to the controller 272, which may also be operable to directly obtain one or more of the above-described signals. The controller 272 may also be operable to obtain and/or determine one or more parameters (including corresponding parameter values) relating to the wellbore conditions, the CT 118, the pump 150, or the CT injector 110.

The controller 272 further includes a processor that may further be operable to develop or obtain a model 274 of the CT 118 and any toolstring during the wellbore intervention operation, including data relating to a given set of wellbore conditions. The model 274 may be, for example a forward equation and may include differential equations that satisfy the parameters detected by the sensors 280. For example, the model 274 may be a model of the friction coefficient at each point along the length of the CT 118. The model 274 may be used to determine at least one modeled property related to the CT 118 and any toolstring given various actual wellbore conditions. The model 274 may be developed using data collected over a given time period (e.g., days, weeks, months or years) while conducting well intervention operations by the CT injector system 100 and/or by one or more other CT injector systems having similar properties. The modeled property may then be used in an inversion process to determine a current friction coefficient, μ, for any position along the unspooled portion of the CT and attached toolstring.

The current friction coefficient μ may then be input into a generative model 276 to predict a future value of the friction coefficient μ for the position at a future wellbore depth. As explained above, the generative model 276 may include a Markov decision process. The predicted future friction coefficient μ may then be used in a torque-drag model 278 of the unspooled portion of the CT or attached toolstring to determine, or predict, a future drag force at the position for future wellbore depths.

For example, the torque drag model 278 may model resultant force and moment vectors F, M on the CT 118 and any toolstring using the following equations:

$$\frac{\partial F}{\partial s} + w = 0 \quad \text{(Eq. 1)}$$

$$\frac{\partial M}{\partial s} + t \times F + m = 0 \quad \text{(Eq. 2)}$$

where s is the length of the drillstring, m is the distributed torque per unit length of the drillstring, and t×F is the cross product between a resultant force F and a tangent vector t of the resultant force. w, which is the force per unit length, is given as follows where $w_{bp}$ and $w_c$ are buoyant weight per unit length and contact force per unit length respectively:

$$w = w_{bp} + w_c + w_d \quad \text{(Eq. 3)}$$

$w_d$ is the friction drag force per unit length and the computation of $w_d$ is as follows:

$$w_d = \mu w_c(\sin\theta n - \cos\theta b) - \mu w_c t \quad \text{(Eq. 4)}$$

where θ is the inclination angle of the CT 118 at any given location, n and t are the normal vector and tangent vectors of the force applied to the CT 118 at any given location along the CT 118, and b is the binormal vector of the helically-shaped resultant force at the location along the CT 118.

The controller 272 automatically predicts any wellbore depth at which the CT 118 will or will likely incur a lock-up if the predicted drag force $w_d$ at a position along the CT 118 or toolstring is equal to or greater than a critical buckling load of the CT 118 or toolstring at the position. The critical buckling load, $F_{cr}$, may be calculated using any suitable method. For example, a classical buckling theory determines $F_{cr}$ as follows:

$$F_{cr} = \frac{\sqrt{4EIW_E}}{r_e} \quad \text{(Eq. 5)}$$

where $F_{cr}$ is the critical buckling load, E is the Young's Modulus of the CT, I is the moment of inertia of the CT, $W_E$ is the equivalent weight of the CT, and $r_e$ is the effective radial clearance between the outer surface of the CT and the closest inside wall of the wellbore. As an alternative example, a modern theory for the determination of buckling load as follows:

$$F_{CR(sinusoidal)} = \sqrt[2]{\frac{EI\omega\sin(Inc)}{r}} \quad \text{(Eq. 6)}$$

$$F_{CR(helical)} = \sqrt[\lambda]{\frac{EI\omega\sin(Inc)}{r}} \quad \text{(Eq. 7)}$$

where EI is the stiffness of the CT, ω is the buoyed linear weight of the CT, Inc is the inclination of the wellbore at the position of the CT, λ is the helical buckling coefficient (greater than 2.82), and r is the radial clearance between the outer surface of the CT and the closest inside wall in the wellbore, which may be the inside wall of the wellbore or of a casing or production tubing in the wellbore.

Once a wellbore depth at which a predicted future lock-up will occur is predicted, the controller 272 automatically controls the pump 150 in both start time and pump rate to pump a FR through the CT 118 and into the wellbore 113 to ensure that the FR reaches the wellbore depth of the predicted lock-up to prevent the lock-up.

The model 274, including the forward equation, and the generative model 276 thus provide the controller 272 the ability to automatically predict and prevent future lock-ups. For example, the generative model 276 and the torque-drag model 278 provide the ability of the controller 272 to automatically control the pumping of FR into the wellbore 113 before the lock-up occurs to prevent a lock-up and continue the injection of the CT 118.

In addition, the process of anticipating future lock-ups involves determining future friction coefficients and drag forces. Using the predicted friction coefficients and drag forces, the controller 272 is also able to automatically determine the optimal amount of FR to be pumped into the wellbore 113 to prevent the lock-up. In most cases, the optimal amount of FR will be the minimum amount of FR required to prevent the lock-up. Thus, not only is a future lock-up prevented, but the system is optimized by minimizing the amount of FR pumped into the wellbore 113 to do so. In one or more embodiments, the controller 272 is operable to continuously monitor wellbore conditions as the CT injection operation is performed and adjust the amount of FR, the pump start time, and/or pump rate of the FR into the CT 118 as needed. For example, the controller 272 may be operable to automatically determine and adjust the optimal amount of FR continuously, periodically, randomly, or based on a pre-selected schedule. The entire operation including monitoring the wellbore conditions related to the operation of injecting the CT 118 and toolstring, predicting the wellbore depth at which a future lock-up will occur, and pumping FR into the wellbore 113 to prevent the lock-up is designed to be fully automatic and not needing operator intervention. Thus, the disclosed systems and methods significantly reduce operator burden. Further, by determining the optimized, or minimum, amount of FR to be pumped into the wellbore 113 in accordance with techniques disclosed herein, the disclosed systems and methods avoid the issue of pumping too little FR, resulting in incurring the lock-up, or too high, resulting in pumping more FR than is needed. Further, automatic operation throughout the operation of injecting the CT 118 may ensure continued injection of the CT 118 and toolstring until a target wellbore depth is reached.

Figure 3:
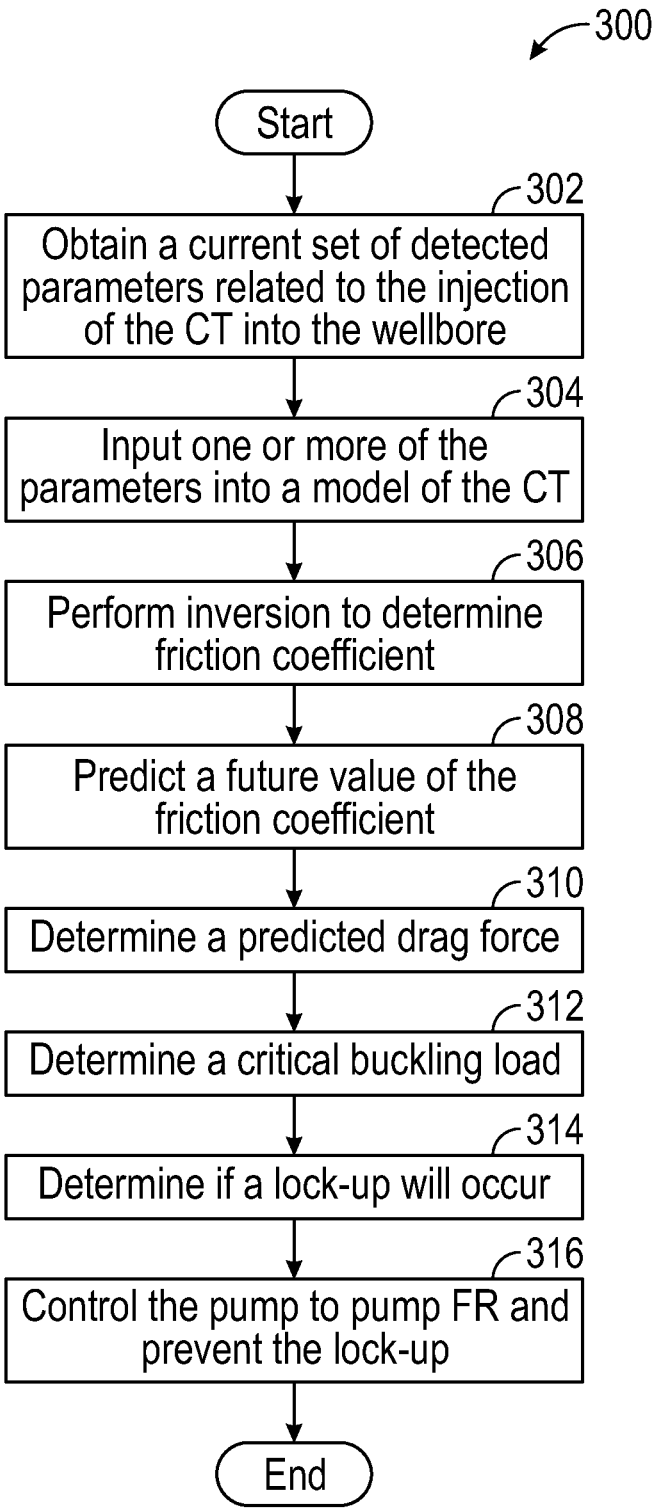
FIG. 3 is a flow chart illustrating an example operation for predicting if a lock-up of coiled tubing will occur during the wellbore intervention operation for the system of FIG. 1, in accordance with one or more embodiments of the present disclosure.

FIG. 3 is an example operation 300 for preventing a predicted future lock-up of the CT 118 as the CT 118 and any attached toolstring are being injected into the wellbore 113, in accordance with one or more embodiments. The operation 300 may be implemented by the controller 272 as discussed with reference to FIG. 2.

At step 302, the controller 272 obtains a current set of detected parameters related to the injection of the CT into the wellbore. The detected parameters may include any of the above-described parameters relating to the current CT injection operation being performed by the CT injector 110. For example, the current set of parameters may include properties of the unspooled portion of the CT 118, wellbore conditions, operation parameters of the CT injector 110, and operation parameters of the pump 150. As described above, the controller 272 receives signals indicative of the detected parameters and processes the signals to determine the measured parameters or any parameters calculated therefrom.

At step 304, the controller 272 inputs one or more of the parameters into a model of the CT and any attached toolstring. The model includes a forward equation as discussed above that may include at least one differential equation that satisfies the detected parameters relating to the CT 118. Using the detected parameters as inputs, the model outputs the friction coefficient at each point along the length of the CT 118.

At step 306, the controller 272 automatically performs an inversion process based on the output of the model to determine the friction coefficient of the CT at least one position along the length of the CT and any attached toolstring.

At step 308, the controller 272 automatically uses the determined friction coefficient as an input into a generative model, e.g., a Markov decision process, to predict a future value of the friction coefficient at the position along the CT or any attached toolstring at a future wellbore depth and assuming certain wellbore conditions.

At step 310, the controller 272 automatically determines a predicted drag force at the position by using the predicted friction coefficient in a torque-drag model of the CT and any attached toolstring.

At step 312, the controller 272 automatically determines the critical buckling load of the CT and any attached toolstring at the position at the future wellbore depth. However, the determination of the critical buckling load may be performed before or in parallel with any of the previous steps.

At step 314, the controller 272 automatically determines if the predicted drag force at the position along the CT and any attached toolstring exceeds the critical buckling load of the CT and any attached toolstring at that position.

At step 316, if the predicted drag force exceeds the critical buckling load, the controller 272 automatically predicts that a lock-up will occur at the future wellbore depth. The depth prediction does not necessarily pinpoint an exact depth the lock-up will absolutely occur. Instead, the prediction is based on a depth near which the lock-up is likely to occur. The controller 272 then controls the pump 150 to pump FR into the CT and out into the wellbore. The controller 272 automatically controls the operation of the pump such that the FR reaches the annulus between the CT and the wellbore at the future wellbore depth before the position along the CT and any attached toolstring reaches the future wellbore depth, thus preventing the future lock-up. As part of step 316, the controller 272 may also automatically determine the minimum amount of FR needed to prevent the lock-up and control the pump to pump up to only the minimum amount. Pumping only the minimum amount of FR is a way to optimize performance of the CT injector system by conserving FR and only using the amount of FR needed to prevent lock-up.

The process described in steps 302-316 may be performed repeatedly throughout the injection of the CT into the wellbore. Repeated determinations of future wellbore lock-ups allows the controller 272 to auto-adjust the flow rate and pump time of the FR as needed in real-time based on the operation of the controller 272 until the CT and any attached toolstring reach a target wellbore depth.

Figure 4:
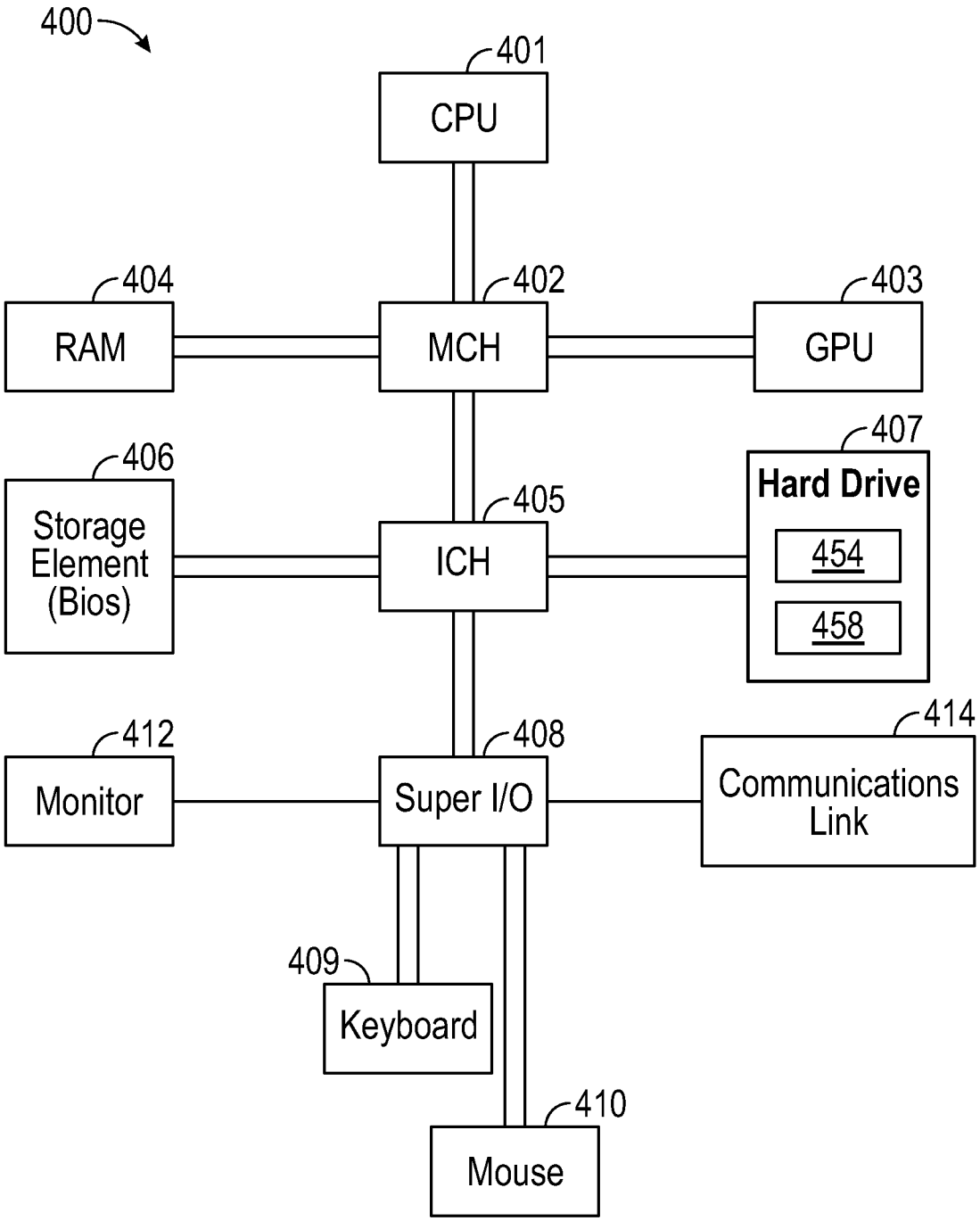
FIG. 4 is a diagram illustrating an example information handling system, in accordance with one or more embodiments of the present disclosure.

FIG. 4 is a diagram illustrating an example information handling system (IHS) 400, for example, for use with the CT injector system 100 of FIG. 1, the system 200 shown in FIG. 2, or systems shown or described in any other figures, in accordance with one or more embodiments of the present disclosure. The IHS 170/270 and/or the controller 272 discussed above with reference to FIGS. 1 and 2 may take a form similar to the IHS 400. A processor or central processing unit (CPU) 401 of the IHS 400 is communicatively coupled to a memory controller hub (MCH) or north bridge 402. The processor 401 may include, for example a microprocessor, microcontroller, digital signal processor (DSP), application specific integrated circuit (ASIC), or any other digital or analog circuitry configured to interpret and/or execute program instructions and/or process data. Processor 401 may be operable to interpret and/or execute program instructions or other data retrieved and stored in any memory such as memory 404 or hard drive 407. Program instructions or other data may constitute portions of a software or application, for example application 458 or data 454, for carrying out one or more methods described herein. Memory 404 may include read-only memory (ROM), random access memory (RAM), solid state memory, or disk-based memory. Each memory module may include any system, device or apparatus operable to retain program instructions and/or data for a period of time (for example, non-transitory computer-readable media). For example, instructions from a software or application 458 or data 454 may be retrieved and stored in memory 404 for execution or use by processor 401. In one or more aspects, the memory 404 or the hard drive 407 may include or comprise one or more non-transitory executable instructions that, when executed by the processor 401 cause the processor 401 to perform or initiate one or more operations or steps. The IHS 400 may be preprogrammed or it may be programmed (and reprogrammed) by loading a program from another source (for example, from a CD-ROM, from another computer device through a data network, or in another manner).

The data 454 may include treatment data, geological data, fracture data, seismic or micro seismic data, data relating to properties of the CT 118, data relating to properties of the CT injector 110, data relating to measured parameters during a coiled tubing injector operation or any other appropriate data. In one or more aspects, a memory of a computing device includes additional or different data, application, models, or other information. In one or more aspects, the data 454 may include geological data relating to one or more geological properties of the subterranean formation. For example, the geological data may include information on the wellbore, completions, or information on other attributes of the subterranean formation. In one or more aspects, the geological data includes information on the lithology, fluid content, stress profile (for example, stress anisotropy and maximum and minimum horizontal stresses), pressure profile, spatial extent, or other attributes of one or more rock formations in the subterranean zone. The geological data may include information collected from well logs, rock samples, outcroppings, seismic or microseismic imaging, or other data sources.

The one or more applications 458 may comprise one or more software applications, one or more scripts, one or more programs, one or more functions, one or more executables, or one or more other modules that are interpreted or executed by the processor 401. The one or more applications 458 may include one or more machine-readable instructions for performing one or more of the operations related to any one or more aspects of the present disclosure. The one or more applications 458 may include machine-readable instructions for determining optimized amounts of FR to be used, as described with reference to FIGS. 1-4. The one or more applications 458 may obtain input data, such as data relating to properties of the CT 118, data relating to properties of the CT injector 110, data relating to measured parameters during a coiled tubing injector operation, seismic data, well data, treatment data, geological data, fracture data, or other types of input data, from the memory 404, from another local source, or from one or more remote sources (for example, via the one or more communication links 414). The one or more applications 458 may generate output data and store the output data in the memory 404, hard drive 407, in another local medium, or in one or more remote devices (for example, by sending the output data via the communication link 414).

Modifications, additions, or omissions may be made to FIG. 4 without departing from the scope of the present disclosure. For example, FIG. 4 shows a particular configuration of components of the IHS 400. However, any suitable configurations of components may be used. For example, components of the IHS 400 may be implemented either as physical or logical components. Furthermore, in one or more aspects, functionality associated with components of the IHS 400 may be implemented in special purpose circuits or components. In other aspects, functionality associated with components of the IHS 400 may be implemented in configurable general purpose circuit or components. For example, components of the IHS 400 may be implemented by configured computer program instructions.

Memory controller hub 402 may include a memory controller for directing information to or from various system memory components within the IHS 400, such as memory 404, storage element 406, and hard drive 407. The memory controller hub 402 may be coupled to memory 404 and a graphics processing unit (GPU) 403. Memory controller hub 402 may also be coupled to an I/O controller hub (ICH) or south bridge 405. I/O controller hub 405 is coupled to storage elements of the IHS 400, including a storage element 406, which may comprise a flash ROM that includes a basic input/output system (BIOS) of the computer system. I/O controller hub 405 is also coupled to the hard drive 407 of the IHS 400. I/O controller hub 405 may also be coupled to an I/O chip or interface, for example, a Super I/O chip 408, which is itself coupled to several of the I/O ports of the computer system, including a keyboard 409, a mouse 410, a monitor 412 and one or more communications link 414. Any one or more input/output devices receive and transmit data in analog or digital form over one or more communication links 414 such as a serial link, a wireless link (for example, infrared, radio frequency, or others), a parallel link, or another type of link. The one or more communication links 414 may comprise any type of communication channel, connector, data communication network, or other link. For example, the one or more communication links 414 may comprise a wireless or a wired network, a Local Area Network (LAN), a Wide Area Network (WAN), a private network, a public network (such as the Internet), a wireless fidelity or WiFi network, a network that includes a satellite link, or another type of data communication network.

As another example, the CT injector system 100 shown in FIG. 1 may also be used to perform a wellbore cleanout operation, thus making the CT injector system 100 a system for performing a wellbore cleanout operation. For purposes of this disclosure, a wellbore cleanout operation is an operation for the removal of wellbore-fill material, such as sand, scale, or organic materials, and other solids or debris from the wellbore 113 or, as in the case of the example below, from a production tubing inside the wellbore 113. Many reservoirs produce some sand or fines that may not be carried to surface in the produced fluid. Accumulations of fill material may eventually increase in concentration within the wellbore, possibly restricting production. The process of cleaning sand or solids out of a wellbore in a cleanout operation includes pumping a fluid down into the well, dislodging and entraining the solids into the fluid, and subsequently carrying the solids to the surface.

Although FIG. 1 shows a CT 118, it should be appreciated that the wellbore cleanout operation can be performed using other suitable conveyances and is not limited to only using CT. Further, although not shown, a toolstring may optionally be attached to the end of the CT 118. The toolstring may include one or more tools suitable for performing a wellbore cleanout operation, such as a wellbore cleanout tool including a nozzle.

For the wellbore cleanout operation, instead of FR, the container 152 contains a wellbore cleanout fluid, which may be any suitable cleanout fluid, such as an aqueous fluid or a chemical for dissolving or dislodging solids. Also not shown in FIG. 1, the wellbore cleanout system 100 includes at least one sensor operable to detect a wellbore production volume of production fluid per unit time being produced from the wellbore 113 through the production tubing. Also, as described above, FIG. 2 illustrates sensors 280 that are operable to detect wellbore conditions 282, such as a volume of fluid coming out of the wellbore 113 or out of a production tubing within the wellbore 113 per unit time. In the embodiment of the system 100 being a wellbore cleanout system, the controller 272 processor need not develop or obtain a model 274 of the CT 118 and any toolstring during the wellbore cleanout operation.

Figure 5:
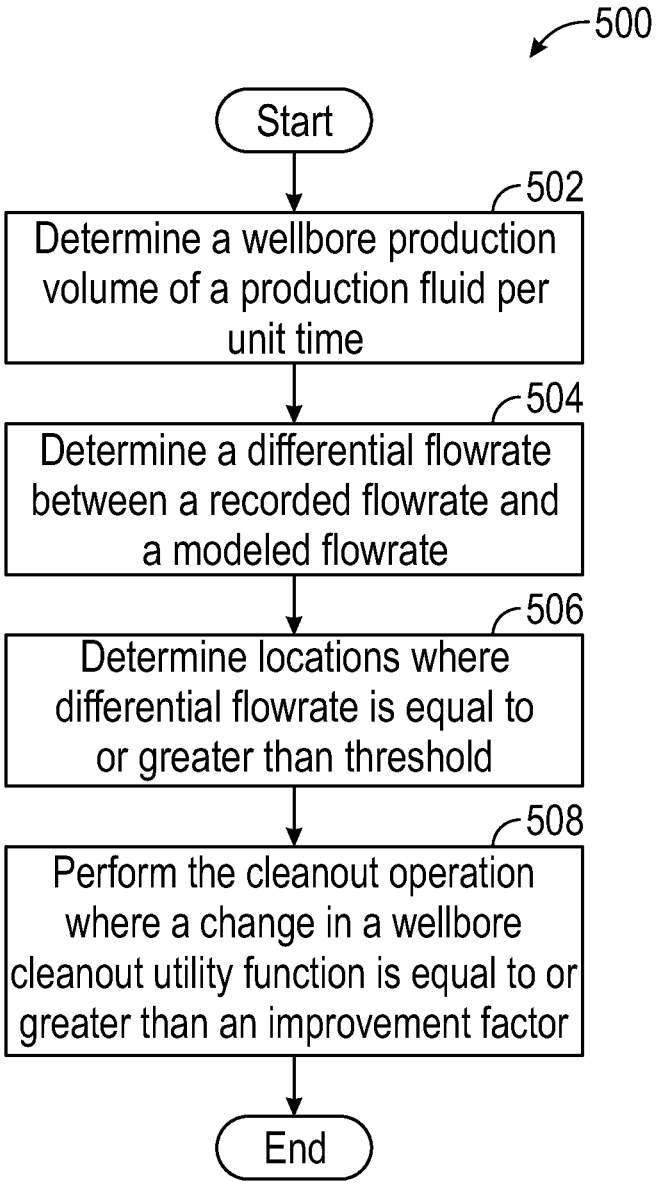
FIG. 5 illustrates example operation for controlling a wellbore cleanout operation using the system of FIG. 1, in accordance with one or more embodiments of the present disclosure.

FIG. 5 is an example operation 500 for a wellbore cleanout operation using the wellbore cleanout system 100, in accordance with one or more embodiments. The operation 500 may be implemented by the controller 272 as discussed with reference to FIG. 2.

At step 502, the controller 272 determines a wellbore production volume of a production fluid per unit time being produced from the production tubing. As described above, the controller 272 receives signals indicative of the production volume from a sensor and processes the signals to determine the production volume.

At step 504, the controller 272 is operable to automatically determine a differential flowrate for locations along the production tubing based on a difference between a recorded flowrate and a modeled flowrate at each location. To determine the recorded flowrate, $q_{recorded}^{i}$, sensors on the toolstring on the CT 118 may be used to log fluid flowrate as the toolstring travels along the production tubing. In addition or alternatively, a fiber optic distributed sensor may be included along the CT 118 that is configured to measure fluid flowrate along the CT 118 within the production tubing.

To determine the modeled flowrate, $q_{modelled}$, the controller 272 is operable to estimate a flowrate along a streamline through the wellbore 113 from a reservoir producing the production fluids. To estimate the flowrate, a flowrate along the streamline is modeled using the equation:

$$\frac{\partial u}{\partial t} + u\frac{\partial u}{\partial x} = \nu\frac{\partial^2 u}{\partial x^2} \quad \text{(Eq. 8)}$$

The solution u(x, t) defines the flowrate along the production tubing and may be aliased subsequently as the estimated flowrate q or q(x, t).

The controller 272 is then operable to estimate an initial wellbore production volume per unit time based on the estimated flowrate using the equation:

$$V_p^{initial} = \pi r^2\left(\int_t^{t_n} q(x, t) - \phi\right), \quad \text{(Eq. 9)}$$

where r is an inner radius of the production tubing, $t_n$ is the duration of time the system is in operation, $\phi$ is the length of the production tubing, and q(x, t) is the estimated flowrate.

The estimated flowrate is expected to have inaccuracies due to the imprecision of the estimated flowrate so the controller 272 then compares the estimated initial wellbore production volume per unit time to the recorded wellbore production volume of production fluid per unit time ($V_p^{recorded}$) detected from the sensor. In doing so, the controller 272 automatically performs an inversion process to adjust the estimated flowrate until the estimated initial wellbore production volume per unit time matches the recorded wellbore production volume of production fluid per unit time within a specified error tolerance. Once adjusted to be within the specified error tolerance, the estimated flowrate as adjusted is designated as a modeled flowrate $q_{modelled}$.

Once the modeled flowrate is determined, the controller 272 automatically determines the differential flowrate for locations along the production tubing based on a difference between the recorded flowrate and the modeled flowrate at locations along the production tubing according to the equation:

$$q_{differential}^{i} = \left(q_{recorded}^{i} - q_{modeled}^{i}\right)^2 \quad \text{(Eq. 10)}$$

At step 506, the controller 272 automatically determines locations or regions along the production tubing where the differential flowrate is equal to or greater than a predetermined threshold. The predetermined threshold may be based on such factors as debris particle size, scale hardness and thickness, hydrostatic pressure, and build angle of a heel of the wellbore (in lateral wellbore configurations).

At step 508, the controller 272 automatically controls deployment of a conveyance, such as CT 118, into the wellbore to perform the cleanout operation at any of the determined locations where a change in a wellbore cleanout utility function using the modeled flowrate compared to using the recorded flowrate is equal to or greater than an improvement factor. To do so, a cleanout utility function is selected for the cleanout operation that estimates the fraction of the original production volume that will be recovered by performing the cleanout operation according to the equation:

$$U: \left(r_v, g_e, q, t, \theta, V_p^{recorded}\right) \rightarrow [0, 1], \quad \text{(Eq. 11)}$$

where $r_v$ is the volume of the reservoir producing the production fluids, $g_e$ is the wellbore type (e.g., gas, liquid, or a mixture of gas and liquid), q is the flowrate through the production tubing, t is the wellbore lifetime, $\theta$ is the hyperparameter of the formation geomechanical properties, and $V_p^{recorded}$ is the recorded wellbore production volume of production fluid per unit time. In Eq. 11, U maps the vector of parameters to the closed interval 0, 1. In essence, U acts like a likelihood function and the role of the hyperparameter, $\theta$, is to tune the model to mitigate the cumulative impact of errors propagating through the multi-physics models. Since $\theta$ is a heuristic, the value $\theta$ takes depends on the range of the realization of the other parameters and the amount of uncertainty in the results calculated from the underlying physics models. The controller 272 compares the value of the cleanout utility function using the modeled flowrate to the value of the cleanout utility function using the recorded flowrate. If the difference is equal to or greater than an improvement factor at any of the determined locations, then the controller 272 automatically controls the system 100 to control the deployment of the conveyance and the pumping of cleanout fluid through the conveyance to perform the cleanout operation at those locations. The improvement factor may be determined based on the following equation:

$$k = c(1 - U_{recorded}), \quad \text{(Eq. 12)}$$

where $U_{recorded}$ is a value of the wellbore cleanout utility function using the recorded flowrate, c>0, and $c \in (0,1)$.

With respect to the HIS 400, described above, the processor 401 may include one or more applications 458 that include machine-readable instructions for performing and optimizing a wellbore cleanout operation to minimize time and cost. The controller 272 is thus operable to automatically control the system 100 to perform the wellbore cleanout operation only at the locations where the wellbore cleanout operation will meet or surpass an improvement factor, thus minimizing the time and cost of the overall operation and optimizing efficiency compared to performing the wellbore cleanout operation along the entire length of the production tubing.

Figure 6:
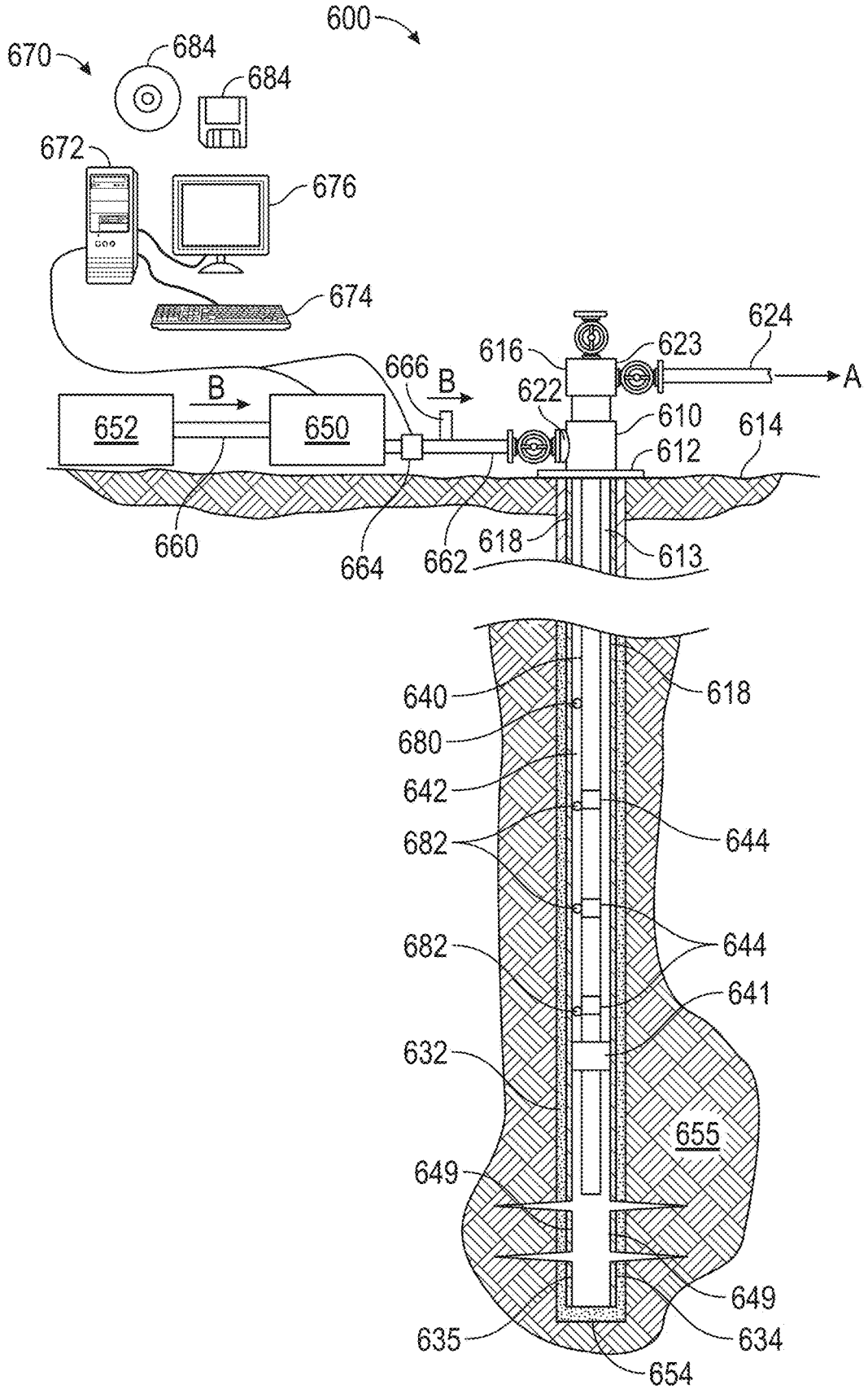
FIG. 6 illustrates a schematic of an example gas lift system with which aspects of the present disclosure may be practiced.

As another example, FIG. 6 illustrates a schematic diagram of an example gas lift system 600 at a wellsite in which aspects of the present disclosure may be practiced. As shown in FIG. 6, the wellsite that includes a gas injection spool 610 is shown as part of a wellhead 612 of a wellbore 613 at a ground surface 614 that extends into a subterranean formation 655. The wellhead 612 also includes a production spool 616 that includes an upper valve 623 leading to a production flow line 624 for flowing production fluid from the well 613 as indicated by arrow A. It should be appreciated that while a surface well is shown in FIG. 6, the aspects of the present disclosure are also applicable to subsea wells.

The wellbore 613 may be completed with a series of pipe strings, referred to as casing. For simplicity, only one string of casing 618 is shown as being cemented into the formation with cement 632. The casing 618 is in sealed fluid communication with a lower valve 622 that is part of the gas injection spool 610. The combination of the casing 618 and the cement 632 in the wellbore 613 strengthens the wellbore 613 and facilitates the isolation of formations behind the casing 618. It is also understood that the upper valve 623 and the lower valve 622 are part of the wellhead 612, which is schematically shown. The wellhead 612 may also include additional various valves for controlling the flow of fluids into and out of the wellbore 613.

The casing 618 extends into the subsurface formation 655 and has a lower end 634 that traverses to an end 654 of the wellbore 613. For this reason, the wellbore 613 is said to be completed as a cased-hole well. The casing 618 has also been perforated after cementing, with perforations shown at 649. The perforations 649 create fluid communication between a bore 635 of the casing 618 and the surrounding rock matrix making up the subsurface formation 655.

The wellbore 613 finally includes a string of production tubing 640. The production tubing 640 extends from the wellhead 612 down to the subsurface formation 655. In the arrangement of FIG. 6, the production tubing 640 terminates above the perforations 649. However, it is understood that the production tubing 640 may terminate anywhere along the subsurface formation 655.

A production packer 641 is provided along the production tubing 640. The illustrative packer 641 is placed proximate the top of the subsurface formation 655. In this way, the packer 641 is able to seal off an annulus 642 between the production tubing 640 and the surrounding casing 630.

The gas lift system 600 includes a pump 650 and a container 652 for containing gas to be pumped by the pump 650 from the container 652 through a fluid line 660 in the direction shown by the arrow B. The pump 650 receives the gas through the fluid line 660 and then pumps the compressed gas through a fluid line 662 connected on the downstream end to the lower valve 622 also in the direction shown by the arrow B. The pump 650 may be controlled to pump gas from the container 652 into the gas injection spool 610 and down into the wellbore 613, and more specifically into the annulus 642. The pump 650 may be any suitable pump for pumping gas into the annulus 642, for example, a centrifugal pump or any other type of standardized pump.

The gas lift system 600 further includes a valve 664 in the fluid line 662 to control whether gas from the pump 650 enters the annulus 642. The valve 664 may be any suitable remotely operated valve, such as a solenoid valve. In addition, the gas lift system 600 includes a hammer arrestor 666 operable to control a change in pressure downstream of the valve 664. In this manner, the pump 650 may be operated to produce compressed gas in the fluid line 662 upstream of the valve 664 with the valve 664 closed. When the gas upstream of the valve 664 is ready to be injected into the annulus 642, e.g., a minimum pressure or after a certain amount of time, the valve 664 is opened such that the gas is allowed to travel downstream of the valve 664 through the flow line 662 and into the annulus 642. However, if there is sufficient pressure being contained by the valve 664 and the valve 664 is opened too quickly, the sudden release of pressure may damage some of the components of the system. The hammer arrestor 666 operates by absorbing some of the pressure released by the valve 664, thus lessening the change in pressure communicated to components downstream of the valve 664.

The production tubing 640 further includes one or more gas lift valves 644 along the production tubing 640 above the packer 641. The gas lift valves 644 receive gas injected into the annulus 642 between the production tubing 640 and the surrounding casing 618. The gas lift valves 644 then inject that gas into a bore 645 of the production tubing 640 for the purpose of reducing the density of the production fluids flowing in the production tubing 640. The gas lift valves 644 are typically closed and operate by adjusting to an open position when a pressure differential between the annulus 642 outside the gas lift valve 644 and the bore 645 inside the production tubing 640 is large enough. In this manner, production fluids inside the production tubing 640 do not flow out of the production tubing 640 into the annulus 642. Alternatively, the gas lift valves 644 may be controlled to open or close based on signals sent to the valves 644 either electronically, acoustically, or even physically through the pressure in the annulus 642.

To monitor the flow of fluids in the production tubing 640 and communicate with the valves 644, a downhole telemetry system may be included in the wellbore 613. The telemetry system may include a plurality of subsurface communications nodes, including one or more sensor communications nodes 682 and a series of intermediate communications nodes 680. The sensor communications nodes 682 are placed adjacent respective gas lift valves 644, while the intermediate communications nodes 680 are placed along the production tubing 640 according to a pre-designated spacing. The communications nodes 680, 682 send acoustic signals up the wellbore 613 in node-to-node arrangement to the surface to communicate with an information handling system (discussed below).

Although not shown in FIG. 6, the gas lift system 600 includes sensors that measure operational parameters and wellbore conditions. Specifically, the gas lift system 600 includes an optical bubble sensor usable to detect bubbles per unit volume of fluid in the production tubing 640. The optical bubble sensor may be located in a linear (straight) portion of the production tubing 640 where fluid flow is steady and undisturbed. The gas lift system 600 also includes a fluid density sensor for detecting a density of the production fluid in the production tubing 640. The gas lift system 600 may also include sensors measuring the operation of the pump 650, the amount of gas in the container 652, the flowrate and pressure of the gas being pumped into the annulus 642, the pressure of the gas in the annulus 642, or any other suitable operational parameters. The sensors may be included at any appropriate location for measuring the desired parameters and conditions.

Systems and methods of the present disclosure may be implemented, at least in part, with an information handling system (IHS) 670 The IHS 670 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, the IHS 670 may include a processor or processing unit 672, a network storage device, or any other suitable device and may vary in size, shape, performance, functionality, and price. The IHS 670 may include random access memory (RAM), one or more processing resources such as a central processing unit (CPU) or hardware or software control logic, read only memory (ROM), and/or other types of nonvolatile memory. Additional components of the IHS 670 may include one or more disk drives, one or more network ports for communication with external devices as well as various input and output (I/O) devices, such as an input device 674 (e.g., keyboard, mouse, etc.) and a video display 676. The IHS 670 may also include one or more buses operable to transmit communications between the various hardware components.

Alternatively, systems and methods of the present disclosure may be implemented, at least in part, with non-transitory computer-readable media 684. Non-transitory computer-readable media 684 may include any instrumentality or aggregation of instrumentalities that may retain data and/or instructions for a period of time. Non-transitory computer-readable media 684 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The IHS 670 at least partially controls the gas lift system 600 for injecting gas into production fluid as part of a gas lift operation. To control the gas lift system 600, the IHS 670 may be connected to the pump 650, the drive mechanism for the pump 650, and the valve 664 through a wired connection as shown or through wireless communication. During the injection of gas, the optical bubble sensor and fluid density sensor may provide information regarding the state of the injection of gas into the production fluid. Sensors may be included that also detect operation parameters of the pump 650, such as flow rate, that are communicated to the IHS 670. Additionally, the gas lift system 600 may include additional sensors may be included at or near the wellhead 612 to provide information regarding wellbore conditions. Signals from the sensors may be sent to the IHS 670 in real-time via any mechanism or telemetry system.

Figure 7:
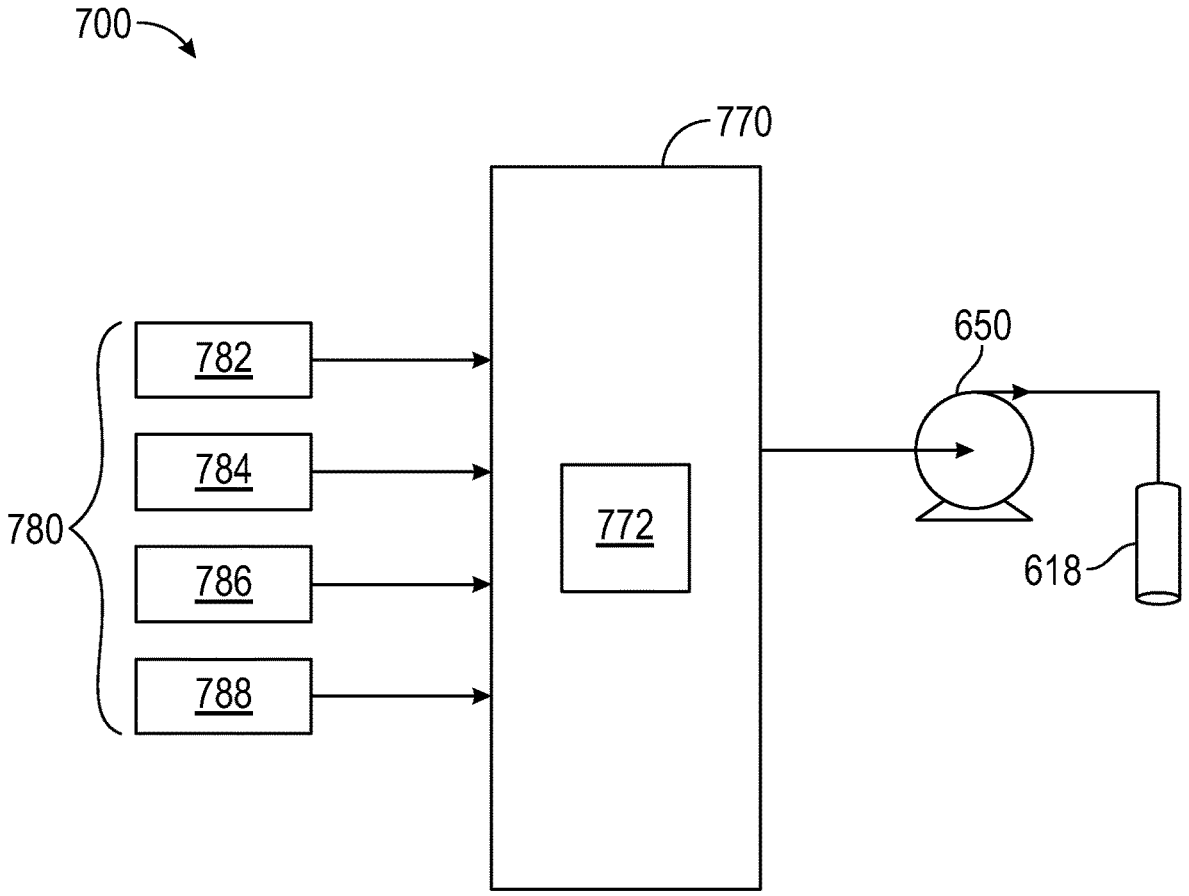
FIG. 7 illustrates a schematic diagram of an example system for performing a gas lift operation using the system of FIG. 6, in accordance with one or more embodiments of the present disclosure.

FIG. 7 illustrates a schematic diagram of an example system 700 for controlling the operation of the pump 650 of the gas lift system 600, in accordance with one or more embodiments of the present disclosure. As shown in FIG. 7, the system 700 includes an information handling system (IHS) 770 similar to the IHS 670 described in FIG. 6 that includes a controller 772. The IHS 770 may be configured to collect data relating to properties of the pump 650 and the container 652, as well as measured parameters such as bubbles in the formation fluid flowing in the production tubing 640 and fluid pressure in the annulus 642 during the gas lift operation. For example, as shown in FIG. 7, the system 700 may include a plurality of sensors 780 detecting various parameters related to the operation of the pump 650 and sending signals feeding the detected data to the IHS 770. As shown, the sensors 780 may detect bubbles in the formation fluid 782, pump operation parameters 784, container parameters 786, gas dispersion parameters related to how evenly gas is spread out in the fluid, and other wellbore conditions 788. The wellbore conditions 788 include such conditions as a volume of fluid coming out of the production tubing 640 per unit time, the density of the production fluid in the production tubing 640, the pressure of the fluid in the annulus 642 and in the production tubing, the rheological properties of the production fluid, the temperature of the production fluid, and the local geometry in relation to gas bubbles in the fluid. The pump operation parameters 784 include such parameters as pump operation status and pump rate.

The signals relating to values of bubbles in the formation fluid 782, pump operation parameters 784, container parameters 786, and other wellbore conditions 788 are fed into the IHS 770 and ultimately to the controller 772, which may also be operable to directly obtain one or more of the above-described signals. The controller 772 may also be operable to obtain and/or determine one or more parameters (including corresponding parameter values) relating to the bubbles in the formation fluid, the pump 150, or the wellbore conditions.

Using the detected bubbles in the formation fluid and the density of the formation fluid, the controller 772 automatically controls the pump 650 in both start time and pump rate to pump enough of the gas into the annulus 642 to achieve the desired production volume of production fluid and effectively lift the production fluid in the tubing out of the wellbore. Further, the controller 772 automatically controls the valve 664 to control whether gas from the pump 650 enters the annulus 642. When the gas upstream of the valve 664 is ready to be injected into the annulus 642, e.g., a minimum pressure or after a certain amount of time, the valve 664 is opened such that the gas is allowed to travel downstream of the valve 664 through the flow line 662 and into the annulus 642.

In addition to the process of injecting gas into the annulus 642, the controller 772 is also able to automatically determine the optimal amount of gas to be pumped into the wellbore 613 to achieve the desired production rate. In most cases, the optimal amount of gas will be the minimum amount of gas required to achieve a desired production rate. Thus, not only is a desired production rate achieved, but the system is optimized by minimizing the amount of gas pumped into the wellbore 613 to do so. In one or more embodiments, the controller 772 is operable to continuously monitor wellbore conditions as the gas lift operation is performed and adjust the amount of gas, the pump start time, and/or pump rate of the gas into the wellbore 613 as needed. For example, the controller 772 may be operable to automatically determine and adjust the optimal amount of gas continuously, periodically, randomly, or based on a preselected schedule. The entire operation including monitoring the wellbore conditions related to the gas lift operation, determining the amount of gas, and pumping the gas into the wellbore 613 to achieve the desired production rate is designed to be fully automatic and not needing operator intervention. Thus, the disclosed systems and methods significantly reduce operator burden. Further, by determining the optimized, or minimum, amount of gas to be pumped into the wellbore 613 in accordance with techniques disclosed herein, the disclosed systems and methods avoid the issue of pumping too little gas, resulting in less production, or too high, resulting in pumping more gas than is needed.

Figure 8:
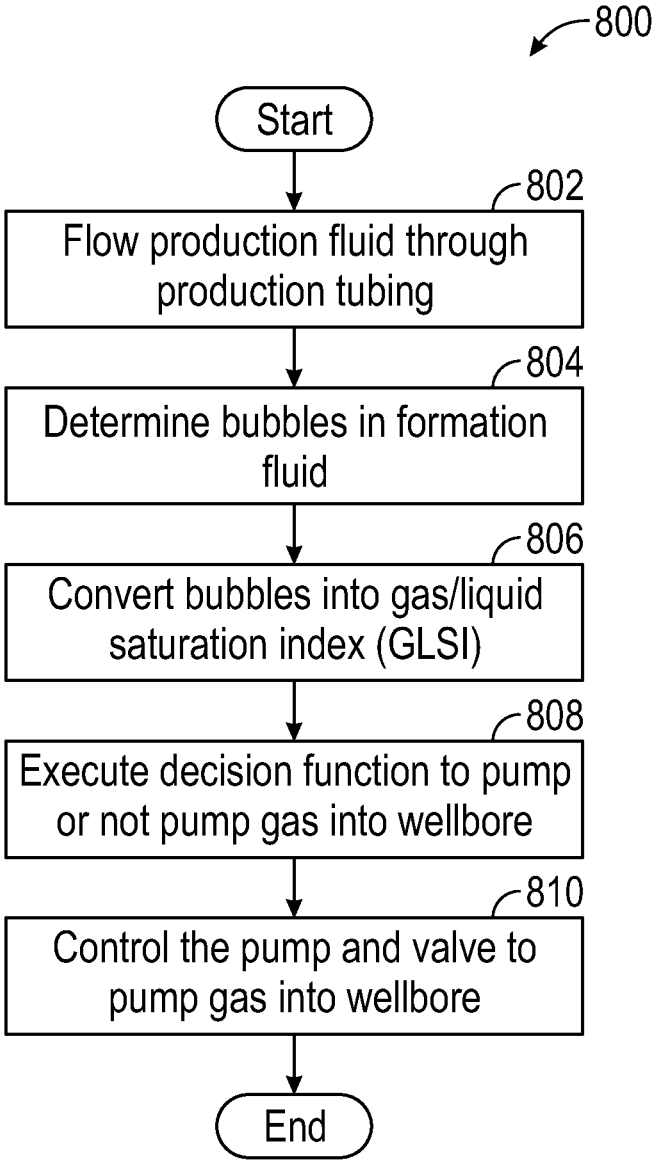
FIG. 8. illustrates an example operation for performing a gas lift operation using the system of FIG. 6, in accordance with one or more embodiments of the present disclosure.

FIG. 8 is an example operation 800 for a gas-lift operation using the gas lift system 600, in accordance with one or more embodiments. The operation 800 may be implemented by the controller 772 as discussed with reference to FIG. 7.

At step 802, production fluid, including reservoir fluid, flows from the reservoir to the surface through production tubing 640.

At step 804, the controller 772 determines the amount of bubbles in the formation fluid per unit volume of fluid flowing through the production tubing 640. As described above, the controller 772 receives signals indicative of the bubbles in the formation fluid per unit volume of fluid from an optical bubble sensor and processes the signals to determine the bubble count.

At step 806, the controller 772 is operable to automatically convert the detected bubbles per unit volume into a gas/liquid saturation index (GLSI) using a transformation function, g, such that $$g: \left(\frac{\text{bubbles}}{\text{unit volume}}\right) \rightarrow GLSI \qquad \text{(Eq. 13)}$$

The transformation function g is a first order partial differential equation the solution of which may be found using, for example, method of characteristics. The transformation function g is used to determine the GLSI is a locally standardized value that conveys the approximate proportion of gas and liquid mixture in a fluid. The standardized values encapsulate information about the multiphase regime, i.e., how the gas bubbles are dispersed in the liquid. The GLSI is determined based on the parameters that the GLSI is greater than zero and GLSI$\in \mathbb{Z}^+$. Optionally, the controller 772 may automatically distribute the determined GLSI into one of three categories: (1) high saturation, (2) moderate saturation, or (3) low saturation.

At step 808, the controller 772 is operable to automatically execute, at designated intervals, a decision function based on the GLSI or categorized GLSI to either pump or not pump gas into the wellbore. The decision function D is based on a fluid density of the production fluid, a number of the gas lift valves 644 in the series, and a well type constant according to the following:

$$D: (GLSI, \rho, n_v, w_t) \rightarrow \{0, 1\}, \qquad \text{(Eq. 14)}$$

where: 0 means no pump operation, 1 means to pump gas, ρ is the fluid density of the production fluid in the production tubing, $n_v$ is the number of valve, and $w_t$ is the well type constant for either a conventional (vertical) or unconventional (deviated) well. Further, the GLSI at each designated interval may be an effective GLSI that includes an average of the GLSIs over a sampling frequency period F, such that:

$$GLSI_{effective} = \left(\sum_{k=1}^{F} GLSI_k\right) \times \frac{1}{F}. \qquad \text{(Eq. 15)}$$

At step 810, if the decision function returns a value of 1, the controller 772 automatically determines that additional gas needs to be pumped into the annulus 642. The controller 772 then automatically controls the pump 650 and the valve 664 to pump gas into the annulus 642, which subsequently enters the production tubing 640, becoming part of the production fluid. As part of step 810, the controller 772 may also automatically determine the minimum amount of gas needed to achieve a desired production rate by continuing to monitor the bubbles in the production fluid and control the pump 650 to pump only the minimum amount of gas needed. Pumping only the minimum amount of gas is a way to optimize performance of the gas lift system by conserving gas and only using the amount of gas needed to achieve the desired production rate.

The process described in steps 802-810 may be performed repeatedly throughout the gas lift operation. Repeated determinations of gas needed allows the controller 772 to auto-adjust the flow rate and pump time of the gas as needed in real-time based on the operation of the controller 772 to achieve and maintain a desired production rate.

With respect to the IHS 400, described above, the processor 401 may include one or more applications 458 that also include machine-readable instructions for performing and optimizing a gas lift operation to efficiently maintain a desired production rate. The controller 772 is thus operable to automatically control the system 600 to perform the gas lift operation using only the minimum amount of gas needed, thus minimizing the time and cost of the overall operation and optimizing efficiency compared to performing the gas lift operation based on set-points not indicative of actual production, such as annulus pressure.

Examples of the Above Embodiments Include:

Example 1 is a system for performing an intervention operation in a wellbore using a friction reducer fluid. The system includes a coiled tubing insertable into the wellbore and a pump operable to pump the friction reducer fluid through the coiled tubing and into the wellbore. The system also includes sensors operable to detect wellbore conditions and a controller comprising a processor. The controller is operable to automatically predict a wellbore depth at which the coiled tubing will incur a lock-up in the future based on the wellbore conditions and control the pump to pump the friction reducer fluid though the coiled tubing and into the wellbore to prevent the future lock-up.

In Example 2, the embodiments of any preceding paragraph or combination thereof further include wherein the controller is operable to automatically predict the wellbore depth the coiled tubing will incur the future lock-up based on a generative model usable to predict a future friction coefficient of the coiled tubing.

In Example 3, the embodiments of any preceding paragraph or combination thereof further include wherein the generative model comprises a Markov chain.

In Example 4, the embodiments of any preceding paragraph or combination thereof further include wherein the controller is operable to automatically predict the wellbore depth at which the coiled tubing will incur the future lock-up based on a current friction coefficient for the coiled tubing determined using a model for the coiled tubing and the wellbore conditions that is used in the generative model.

In Example 5, the embodiments of any preceding paragraph or combination thereof further include wherein the wellbore depth at which the coiled tubing will incur the future lock-up is the wellbore depth at which a predicted future friction drag force determined using the predicted future friction coefficient is equal to or greater than a critical buckling load of the coiled tubing.

In Example 6, the embodiments of any preceding paragraph or combination thereof further include wherein the controller is operable to automatically control the pump based on at least one of a pumping start time or a pump rate.

In Example 7, the embodiments of any preceding paragraph or combination thereof further include wherein the controller is further operable to automatically determine an amount of the friction reducer fluid to prevent the future lock-up and control the pump to pump the amount of the friction reducer through the coiled tubing into the wellbore to prevent the future lock-up.

In Example 8, the embodiments of any preceding paragraph or combination thereof further include wherein the controller is further operable to continue to automatically determine the amount of friction reducer to prevent future lock-up and continue to automatically control the pump to pump the friction reducer to prevent future lock-ups, until the coiled tubing is inserted to a target wellbore depth.

In Example 9, the embodiments of any preceding paragraph or combination thereof further include wherein the controller is further operable to automatically determine a minimum amount of the friction reducer fluid to prevent the future lock-up and control the pump to pump the minimum amount of the friction reducer through the coiled tubing into the wellbore to prevent the future lock-up.

Example 10 is a method of operating a coiled tubing injection system to perform a coiled tubing injection operation. The method includes injecting a coiled tubing into a wellbore using a coiled tubing injector and monitoring wellbore conditions relating to the injection operation using sensors to detect wellbore conditions. The method further includes automatically predicting, using a controller comprising a processor, a wellbore depth at which the coiled tubing will incur a lock-up in the future based on the wellbore conditions. The method further includes automatically controlling a pump using the controller to pump a friction reducer fluid into the wellbore to prevent the future lock-up.

In Example 11, the embodiments of any preceding paragraph or combination thereof further include wherein automatically predicting the wellbore depth of the future lock-up further comprises using a generative model to predict a future friction coefficient of the coiled tubing.

In Example 12, the embodiments of any preceding paragraph or combination thereof further include wherein the generative model comprises a Markov model.

In Example 13, the embodiments of any preceding paragraph or combination thereof further include wherein automatically predicting the wellbore depth of the future lock-up further comprises using a model for the coiled tubing and the wellbore conditions to determine a current friction coefficient for the coiled tubing usable in the generative model.

In Example 14, the embodiments of any preceding paragraph or combination thereof further include wherein the wellbore depth at which the coiled tubing will incur the future lock-up is the wellbore depth at which a predicted future friction drag force determined using the predicted future friction coefficient is equal to or greater than a critical buckling load of the coiled tubing.

In Example 15, the embodiments of any preceding paragraph or combination thereof further include automatically determining a minimum amount of friction reducer fluid to prevent the future lock-up and automatically controlling the pump to pump the minimum amount of the friction reducer through the coiled tubing into the wellbore to prevent the future lock-up.

Example 16 is a computer-readable medium storing instructions which when processed by at least one processor perform a method of operating a coiled tubing injection system for injecting a coiled tubing into a wellbore and controlling a pump to pump a friction reducer fluid into the wellbore. The method includes monitoring wellbore conditions relating to injecting the coiled tubing. The method further includes automatically predicting, using a controller comprising a processor, a wellbore depth at which the coiled tubing will incur a lock-up in the future based on the wellbore conditions. The method further includes automatically controlling the pump using the controller to pump the friction reducer fluid into the wellbore to prevent the future lock-up.

In Example 17, the embodiments of any preceding paragraph or combination thereof further include wherein automatically predicting the wellbore depth of the future lock-up further comprises using a generative model to predict a future friction coefficient of the coiled tubing.

In Example 18, the embodiments of any preceding paragraph or combination thereof further include wherein automatically predicting the wellbore depth of the future lock-up further comprises using a model for the coiled tubing and the wellbore conditions to determine a current friction coefficient for the coiled tubing usable in the generative model.

In Example 19, the embodiments of any preceding paragraph or combination thereof further include wherein the wellbore depth at which the coiled tubing will incur the future lock-up is the wellbore depth at which a predicted future friction drag force determined using the predicted future friction coefficient is equal to or greater than a critical buckling load of the coiled tubing.

In Example 20, the embodiments of any preceding paragraph or combination thereof further include wherein automatically controlling the pump using the controller further comprises automatically determining a minimum amount of the friction reducer fluid to prevent the future lock-up and automatically controlling the pump to pump the minimum amount of the friction reducer fluid through the coiled tubing into the wellbore to prevent the future lock-up.

Example 21 is a system for performing a wellbore cleanout operation in a production tubing in a wellbore extending through a reservoir. The system comprises a sensor usable to detect a wellbore production volume of a production fluid from the production tubing per unit time, a conveyance insertable into the wellbore, and a controller comprising a processor. The controller is operable to automatically determine a differential flowrate for locations along the production tubing based on a difference between a recorded flowrate and a modeled flowrate at the locations, determine any of the locations where the differential flowrate is equal to or greater than a predetermined threshold, and control deployment of the conveyance into the wellbore to perform the cleanout operation at any of the determined locations where a change in a wellbore cleanout utility function using the modeled flowrate compared to using the recorded flowrate is equal to or greater than an improvement factor.

In Example 22, the embodiments of any preceding paragraph or combination thereof further include wherein the controller is operable to automatically estimate an initial wellbore production volume per unit time based on an estimated flowrate along a streamline through the wellbore from the reservoir and perform an inversion process using the estimated initial wellbore production volume per unit time and the wellbore production volume of production fluid per unit time detected from the sensor to determine the modeled flowrate at the locations.

In Example 23, wherein the controller is operable to automatically estimate the initial wellbore production volume per unit time based on physical characteristics of the production tubing.

In Example 24, the embodiments of any preceding paragraph or combination thereof further include wherein the estimated flowrate along the streamline is estimated based on the following:

$$\frac{\partial u}{\partial t} + u\frac{\partial u}{\partial x} = v\frac{\partial^2 u}{\partial x^2},$$

where the solution u(x, t) is the speed of the production fluid at indicated spatial and temporal coordinates, x is the spatial coordinate, t is the temporal coordinate, and ν is the viscosity of the production fluid from the reservoir.

In Example 25, the embodiments of any preceding paragraph or combination thereof further include wherein the controller is operable to automatically perform the inversion process by adjusting the estimated flowrate until the estimated initial wellbore production volume per unit time matches the wellbore production volume per unit time within a predetermined error tolerance.

In Example 26, the embodiments of any preceding paragraph or combination thereof further include wherein the differential flowrate is determined based on:

$$\left(q^i_{recorded} - q^i_{modeled}\right)^2 = q^i_{differential}.$$

In Example 27, the embodiments of any preceding paragraph or combination thereof further include wherein the wellbore cleanout utility function comprises:

$$U\colon \left(r_v, g_e, q, t, \theta, V_p^{recorded}\right) \rightarrow [0, 1],$$

where $r_v$ is a reservoir volume, $g_e$ is a wellbore type, q is a flowrate, t is a wellbore lifetime, θ is a hyperparameter of the formation geomechanical properties, and $V_p^{recorded}$ is a production volume of production fluid per unit time detected by the sensor.

In Example 28, the embodiments of any preceding paragraph or combination thereof further include wherein the improvement factor is determined based on $$k = c(1 - U_{recorded}),$$

where $U_{recorded}$ is a value of the wellbore cleanout utility function using the recorded flowrate, c>0, and c∈(0,1).

Example 29 is a method of performing a wellbore cleanout operation in a wellbore. The method includes detecting a wellbore production volume of a production fluid from a production tubing per unit time using a sensor. The method further includes automatically determining, using a controller, a differential flowrate at locations along the production tubing in the wellbore based on a difference between a recorded flowrate and a modeled flowrate at the locations. The method further includes automatically determining, using the controller, any of the locations where the differential flowrate is equal to or greater than a predetermined threshold. The method further includes automatically controlling, using the controller, a cleanout system to perform the cleanout operation at any of the determined locations where a change in a wellbore cleanout utility function using the modeled flowrate compared using the recorded flowrate is equal to or greater than an improvement factor.

In Example 30, the embodiments of any preceding paragraph or combination thereof further include automatically estimating, using the controller, an initial wellbore production volume per unit time based on an estimated flowrate along a streamline through the wellbore from the reservoir and automatically performing, using the controller, an inversion process using the estimated initial wellbore production volume per unit time and the wellbore production volume per unit time detected from the sensor to determine the modeled flowrate at the locations.

In Example 31, the embodiments of any preceding paragraph or combination thereof further include wherein automatically estimating the initial wellbore production volume per unit time is based on physical characteristics of the production tubing.

In Example 32, the embodiments of any preceding paragraph or combination thereof further include wherein automatically performing the inversion process comprises adjusting the estimated flowrate until the estimated initial wellbore production volume per unit time matches the wellbore production volume per unit time within a predetermined error tolerance.

In Example 33, the embodiments of any preceding paragraph or combination thereof further include wherein the differential flowrate is determined based on:

$$\left(q^i_{recorded} - q^i_{modeled}\right)^2 = q^i_{differential}.$$

In Example 34, the embodiments of any preceding paragraph or combination thereof further include wherein the wellbore cleanout utility function comprises:

$$U\colon \left(r_v, g_e, q, t, \theta, V_p^{recorded}\right) \rightarrow [0, 1],$$

where $r_v$ is a reservoir volume, $g_e$ is a wellbore type, q is a flowrate, t is a wellbore lifetime, θ is a hyperparameter of the formation geomechanical properties, and $V_p^{recorded}$ is a production volume of production fluid per unit time detected by the sensor.

In Example 35, the embodiments of any preceding paragraph or combination thereof further include wherein the improvement factor is determined based on $$k = c(1 - U_{recorded}),$$

where $U_{recorded}$ is a value of the wellbore cleanout utility function using the recorded flowrate, c>0, and c∈(0,1).

Example 36 is a computer-readable medium storing instructions which when processed by at least one processor perform a method of performing a wellbore cleanout operation in a production tubing in a wellbore. The method includes determining a wellbore production volume of a production fluid from the production tubing per unit time based on detection data from a sensor. The method further includes automatically determining a differential flowrate at locations along the production tubing based on a difference between a recorded flowrate and a modeled flowrate at the locations. The method further includes automatically determining any of the locations where the differential flowrate is equal to or greater than a predetermined threshold. The method further includes automatically controlling a cleanout system to perform the cleanout operation at any of the determined locations where a change in a wellbore cleanout utility function using the modeled flowrate compared using the recorded flowrate is equal to or greater than an improvement factor.

In Example 37, the embodiments of any preceding paragraph or combination thereof further include wherein the instructions further include automatically estimating an initial wellbore production volume per unit time based on an estimated flowrate along a streamline through the wellbore from the reservoir and automatically performing an inversion process using the estimated initial wellbore production volume per unit time and the wellbore production volume per unit time determined from the detection data to determine the modeled flowrate at the locations along the production tubing.

In Example 38, the embodiments of any preceding paragraph or combination thereof further include wherein automatically estimating the initial wellbore production volume per unit time is based on physical characteristics of the production tubing.

In Example 39, the embodiments of any preceding paragraph or combination thereof further include wherein automatically performing the inversion process comprises adjusting the estimated flowrate until the estimated initial wellbore production volume per unit time matches the wellbore production volume per unit time within a predetermined error tolerance.

In Example 40, the embodiments of any preceding paragraph or combination thereof further include wherein the wellbore cleanout utility function includes:

$$U: \left(r_v, g_e, q, t, \theta, V_p^{recorded}\right) \rightarrow [0, 1],$$

where $r_v$ is a reservoir volume, $g_e$ is a wellbore type, q is a flowrate, t is a wellbore lifetime, θ is a hyperparameter of the formation geomechanical properties, and $V_p^{recorded}$ is a production volume of production fluid per unit time detected by the sensor.

Example 41 is a system for performing a gas lift operation using gas to increase production of production fluid through a production tubing in a wellbore from a subterranean formation. The system comprises an optical bubble sensor usable to detect bubbles per unit volume of the production fluid in the production tubing. The system further comprises a pump operable to pump gas into an annulus in the wellbore outside the production tubing, a valve operable to control whether gas from the pump enters the annulus, and a controller. The controller is operable to automatically convert the detected bubbles per unit volume into a gas/liquid saturation index (GLSI) using a transformation function; execute, at designated intervals, a decision function based on the GLSI to either pump or not pump gas into the wellbore; and control the pump and the valve to pump gas into the annulus when indicated by the decision function.

In Example 42, the embodiments of any preceding paragraph or combination thereof further include wherein the GLSI is greater than zero and GLSI∈ $\mathbb{Z}^+$.

In Example 43, the embodiments of any preceding paragraph or combination thereof further include wherein the GLSI is categorized into one of high saturation, moderate saturation, or low saturation.

In Example 44, the embodiments of any preceding paragraph or combination thereof further include wherein the decision function is further based on a density of the production fluid, a number of gas lift valves, and a well type constant.

In Example 45, the embodiments of any preceding paragraph or combination thereof further include wherein the GLSI at each designated interval comprises an effective GLSI comprising an average of GLSIs over a sampling frequency period, F, such that:

$$GLSi_{effective} = \left(\sum_{k=1}^{F} GLSi_k\right) \times \frac{1}{F}.$$

In Example 46, the embodiments of any preceding paragraph or combination thereof further include a hammer arrestor operable to control a change in pressure downstream of the valve.

In Example 47, the embodiments of any preceding paragraph or combination thereof further include wherein the controller is operable to automatically minimize the amount of gas pumped into the annulus by controlling the pump and the valve to not pump gas into the annulus when indicated by the decision function.

Example 48 is a method of performing a gas lift operation to increase production of production fluid through a production tubing in a wellbore from a subterranean formation. The method comprises flowing production fluid, including reservoir fluid from a reservoir in the subterranean formation, through the production tubing. The method further comprises detecting bubbles in the production fluid per unit volume of production fluid using an optical bubble sensor. The method further comprises automatically, using a controller comprising a processor, converting the detected bubbles per unit volume into a gas/liquid saturation index (GLSI) using a transformation function. The method further comprises automatically, using the controller, executing, at designated intervals, a decision function based on the GLSI to either pump or not pump gas into the wellbore. The method further comprises automatically, using the controller, controlling a pump and a valve to pump gas into an annulus in the wellbore outside the production tubing when indicated by the decision function. The method further comprises combining the pumped gas in the annulus with reservoir fluid downhole in the production tubing to decrease a density of the production fluid and increase the flow of reservoir fluid from the subterranean formation through the production tubing.

In Example 49, the embodiments of any preceding paragraph or combination thereof further include wherein the GLSI is greater than zero and GLSI∈ $\mathbb{Z}^+$.

In Example 50, the embodiments of any preceding paragraph or combination thereof further include automatically, using the controller, categorizing the GLSI into one of high saturation, moderate saturation, or low saturation for use in the decision function.

In Example 51, the embodiments of any preceding paragraph or combination thereof further include wherein the decision function is further based on a density of the production fluid, a number of gas lift valves, and a well type constant.

In Example 52, the embodiments of any preceding paragraph or combination thereof further include wherein the GLSI at each designated interval comprises an effective GLSI comprising an average of GLSIs over a sampling frequency period, F, such that:

$$GLSi_{effective} = \left(\sum_{k=1}^{F} GLSi_k\right) \times \frac{1}{F}.$$

In Example 53, the embodiments of any preceding paragraph or combination thereof further include controlling a change in pressure in a flow line downstream of the valve due to operating the valve using a hammer arrestor.

In Example 54, the embodiments of any preceding paragraph or combination thereof further include automatically, using the controller, minimizing the amount of gas pumped into the annulus by controlling the pump and the valve to not pump gas into the annulus when indicated by the decision function.

Example 55 is a computer-readable medium storing instructions which when processed by at least one processor perform a method of performing a gas lift operation using gas to increase production of production fluid through a production tubing in a wellbore from a subterranean formation. The instructions comprise determining bubbles in the production fluid per unit volume of production fluid based on detection data from an optical bubble sensor. The instructions further comprise automatically converting the bubbles per unit volume into a gas/liquid saturation index (GLSI) using a transformation function. The instructions further comprise automatically executing, at designated intervals, a decision function based on the GLSI to either pump or not pump gas into the wellbore. The instructions further comprise automatically controlling a pump and a valve to pump gas into an annulus in the wellbore outside the production tubing when indicated by the decision function.

In Example 56, the embodiments of any preceding paragraph or combination thereof further include wherein the GLSI is greater than zero and $GLSI \in \mathbb{Z}^+$.

In Example 57, the embodiments of any preceding paragraph or combination thereof further include wherein the instructions further comprise automatically categorizing the GLSI into one of high saturation, moderate saturation, or low saturation for use in the decision function.

In Example 58, the embodiments of any preceding paragraph or combination thereof further include wherein the decision function is further based on a density of the production fluid, a number of gas lift valves, and a well type constant.

In Example 59, the embodiments of any preceding paragraph or combination thereof further include wherein the GLSI at each designated interval comprises an effective GLSI comprising an average of GLSIs over a sampling frequency period, F, such that:

$$GLSi_{effective} = \left(\sum_{k=1}^{F} GLSi_k\right) \times \frac{1}{F}.$$

In Example 60, the embodiments of any preceding paragraph or combination thereof further include wherein the instructions further comprise minimizing the amount of gas pumped into the annulus by controlling the pump and the valve to not pump gas into the annulus when indicated by the decision function.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure. As used herein, "about", "approximately", "substantially", and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A system for performing an intervention operation in a wellbore using a friction reducer fluid, comprising:

a coiled tubing insertable into the wellbore;

a pump operable to pump the friction reducer fluid through the coiled tubing and into the wellbore;

sensors operable to detect wellbore conditions; and a controller comprising a processor, wherein the controller is operable to automatically:

predict a wellbore depth at which the coiled tubing will incur a lock-up in the future based on the wellbore conditions; and control the pump to pump the friction reducer fluid though the coiled tubing and into the wellbore to prevent the future lock-up.

2. The system of claim 1, wherein the controller is operable to automatically predict the wellbore depth at which the coiled tubing will incur the future lock-up based on a generative model usable to predict a future friction coefficient of the coiled tubing.

3. The system of claim 2, wherein the generative model comprises a Markov chain.

4. The system of claim 2, wherein the controller is operable to automatically predict the wellbore depth at which the coiled tubing will incur the future lock-up based on a current friction coefficient for the coiled tubing determined using a model for the coiled tubing and the wellbore conditions that is used in the generative model.

5. The system of claim 2, wherein the wellbore depth at which the coiled tubing will incur the future lock-up is the wellbore depth at which a predicted future friction drag force determined using the predicted future friction coefficient is equal to or greater than a critical buckling load of the coiled tubing.

6. The system of claim 1, wherein the controller is operable to automatically control the pump based on at least one of a pumping start time or a pump rate.

7. The system of claim 1, wherein the controller is further operable to automatically:

determine an amount of the friction reducer fluid to prevent the future lock-up; and control the pump to pump the amount of the friction reducer fluid through the coiled tubing into the wellbore to prevent the future lock-up.

8. The system of claim 7, wherein the controller is further operable to continue to automatically determine the amount of friction reducer fluid to prevent future lock-up and continue to automatically control the pump to pump the friction reducer to prevent future lock-ups, until the coiled tubing is inserted to a target wellbore depth.

9. The system of claim 7, wherein the controller is further operable to automatically:

determine a minimum amount of the friction reducer fluid to prevent the future lock-up; and control the pump to pump the minimum amount of the friction reducer fluid through the coiled tubing into the wellbore to prevent the future lock-up.

10. A method of operating a coiled tubing injection system to perform a coiled tubing injection operation comprising:

injecting a coiled tubing into a wellbore using a coiled tubing injector;

monitoring wellbore conditions relating to the injection operation using sensors to detect wellbore conditions;

automatically predicting, using a controller comprising a processor, a wellbore depth at which the coiled tubing will incur a lock-up in the future based on the wellbore conditions; and automatically controlling a pump using the controller to pump a friction reducer fluid into the wellbore to prevent the future lock-up.

11. The method of claim 10, wherein automatically predicting the wellbore depth of the future lock-up further comprises using a generative model to predict a future friction coefficient of the coiled tubing.

12. The method of claim 11, wherein the generative model comprises a Markov model.

13. The method of claim 11, wherein automatically predicting the wellbore depth of the future lock-up further comprises using a model for the coiled tubing and the wellbore conditions to determine a current friction coefficient for the coiled tubing usable in the generative model.

14. The method of claim 11, wherein the wellbore depth at which the coiled tubing will incur the future lock-up is the wellbore depth at which a predicted future friction drag force determined using the predicted future friction coefficient is equal to or greater than a critical buckling load of the coiled tubing.

15. The method of claim 10, further comprising:

automatically determining a minimum amount of friction reducer fluid to prevent the future lock-up; and automatically controlling the pump to pump the minimum amount of the friction reducer fluid through the coiled tubing into the wellbore to prevent the future lock-up.

16. A computer-readable medium storing instructions which when processed by at least one processor perform a method of operating a coiled tubing injection system for injecting a coiled tubing into a wellbore and controlling a pump to pump a friction reducer fluid into the wellbore comprising:

monitoring wellbore conditions relating to injecting the coiled tubing;

automatically predicting, using a controller comprising a processor, a wellbore depth at which the coiled tubing will incur a lock-up in the future based on the wellbore conditions; and automatically controlling the pump using the controller to pump the friction reducer fluid into the wellbore to prevent the future lock-up.

17. The computer-readable medium of claim 16, wherein automatically predicting the wellbore depth of the future lock-up further comprises using a generative model to predict a future friction coefficient of the coiled tubing.

18. The computer-readable medium of claim 17, wherein automatically predicting the wellbore depth of the future lock-up further comprises using a model for the coiled tubing and the wellbore conditions to determine a current friction coefficient for the coiled tubing usable in the generative model.

19. The computer-readable medium of claim 17, wherein the wellbore depth at which the coiled tubing will incur the future lock-up is the wellbore depth at which a predicted future friction drag force determined using the predicted future friction coefficient is equal to or greater than a critical buckling load of the coiled tubing.

20. The computer-readable medium of claim 16, wherein automatically controlling the pump using the controller further comprises:

automatically determining a minimum amount of the friction reducer fluid to prevent the future lock-up; and automatically controlling the pump to pump the minimum amount of the friction reducer fluid through the coiled tubing into the wellbore to prevent the future lock-up.

* * * * *